United States Patent [19]

Bernauer

[11] Patent Number: 4,878,670

[45] Date of Patent: Nov. 7, 1989

[54] HEART PUZZLE

[76] Inventor: Larry W. Bernauer, 1214 Arlington Ave., Davenport, Iowa 52803

[21] Appl. No.: 251,343

[22] Filed: Sep. 30, 1988

[51] Int. Cl.[4] ..... A63F 9/08

[52] U.S. Cl. ..... 273/158

[58] Field of Search ..... 273/158; D21/106

[56] References Cited

U.S. PATENT DOCUMENTS

| | | | |
|---|---|---|---|
| 136,645 | 3/1873 | Ellis | 273/158 |
| D. 225,425 | 12/1972 | Brown | D21/106 |
| 428,455 | 5/1890 | Charshee | 273/158 |
| 1,187,602 | 6/1916 | Blalock | 273/158 |
| 1,726,952 | 9/1929 | Gonzales | 273/158 |

*Primary Examiner*—Anton O. Oechsle

*Attorney, Agent, or Firm*—Robert O. Richardson

[57] ABSTRACT

A plurality of interlocked elements with loop portions on the ends of one element engaging intermediate portions of another element. A game piece with a part too large to pass through the loops has a tongue with spaced sides that may be passed through, up and over certain loops and straddle element portions in manuevering the game piece into and out of engagement with selected elements in a predetermined sequence.

6 Claims, 29 Drawing Sheets

18
20
64
58
24
22
62
56
60
16
50
48
40
10
42
36
54
52
46
44

FIG.15
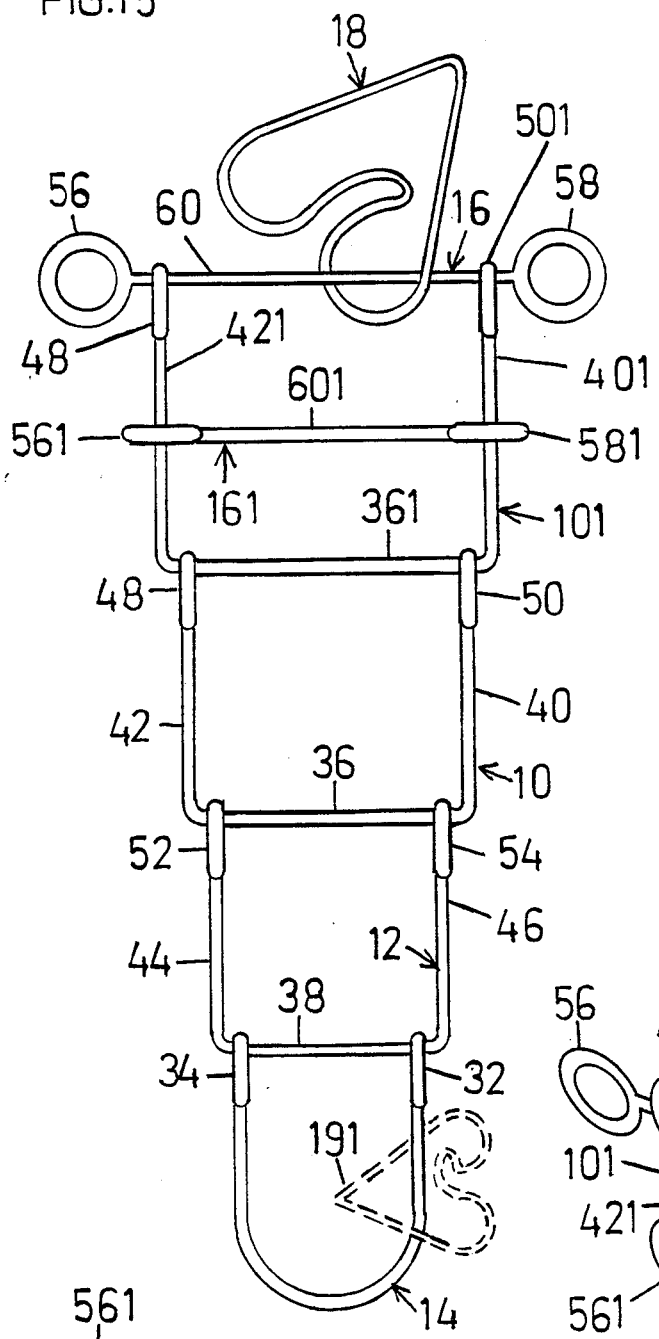
FIG.17
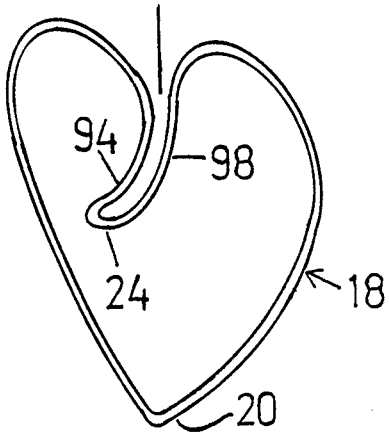
FIG. 18
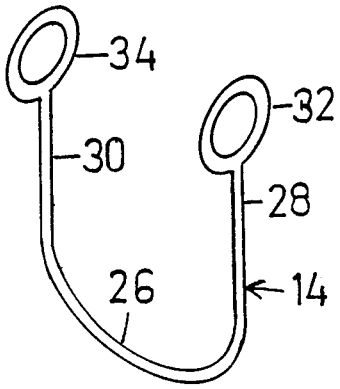
FIG.19
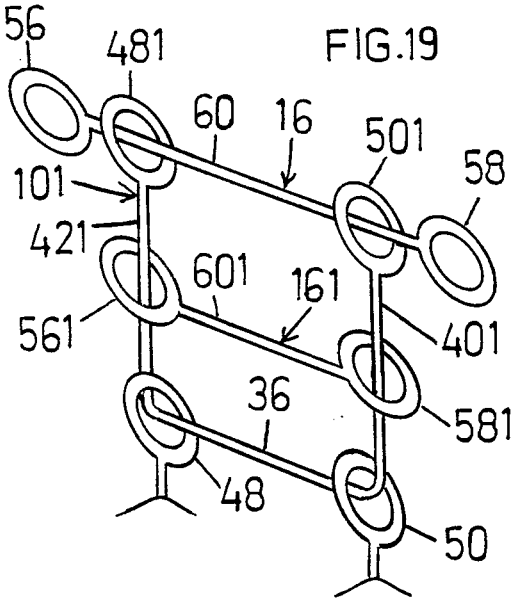
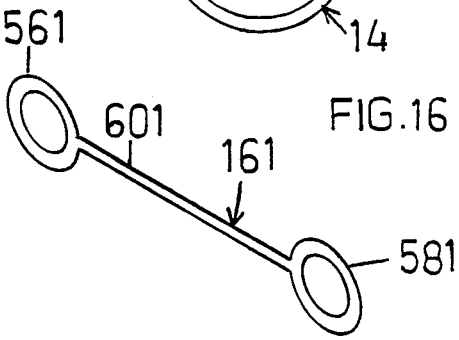
FIG.16

20
174
501
58
172
56
481
24
176
16
581
161
561
50
54
101
18
48
52
162
10
32
12
28
34
30

HEART PUZZLE

FIELD OF INVENTION

This invention relates to puzzles and amusement devices and more specifically to a wire-form puzzle with multiple interlocked elements and a solitary game piece element which threads about and through the interlocked elements in order to interlock the solitary game piece element with the interlocked elements and to free the solitary game piece element from the interlocked elements.

BACKGROUND AND SUMMARY OF THE INVENTION

U.S. Pat. No. 4,542,972 was issued June 25, 1985 to Charles R. Wilmarth for a Wire Puzzle. This puzzle consisted of a first U-shaped element 50 with circular rings at its ends. A second U-shaped element 40 extended through the rings and, in turn, had circular rings at its ends. A dumbbell-shaped third element 30 was unremovably retained within the rings of the second element. A heart-shaped element 60 is positioned on the U-shaped element 50. The object of this puzzle is to work the heart-shaped element 60 from element 50 onto the dumbbell-shaped element 30, remove it from 30 and 50 while straddling it on element 40. From element 40 the heart-shaped element 60 is worked back onto element 30 and then freed from all elements. The heart-shaped element 60 is of such size that it may be passed through the rings.

U.S. Pat. No. 4,497,489 was issued Feb. 5, 1985 to Wilmer O. Pelletier for Bow and Ladder Amusement Device. This puzzle consists of three U-shaped interlocked elements 12, 14 and 16 with circular rings at their ends. A dumbbell element 30 extends through the rings of element 12. An oval bow 40 is passed through various rings on one side of the elements as it is worked down the elements, and passed through various rings on the other side of the elements as it is worked back up to the dumbbell element 30 and freed from all the elements. Here again the bow 40 is of such size that it may be passed through the rings in solving the puzzle.

In accordance with the present invention a plurality of U-shaped members are interlinked in a manner somewhat similar to the elements in the patents above mentioned. However, the removable game piece element in the present invention is too large to be passed through the loops which connect the elements together. The removable game piece element is of an enlarged heart-shaped configuration that has a loop with spaced sides extending from its throat. This loop forms a tongue that extends out of the plane formed by the rest of the heart element. This tongue and spaced sides are worked through and over the various loops in order to move the heart sequentially from connection with the top element to the lowermost element. All this is accomplished without passing the rib portion of the heart element, from its throat to its apex, through any of the loops on any of the elements. This distinguishing feature requires a totally different mode of operation from that of the elements in the foregoing patents as will be apparent as the description of the present invention proceeds.

BRIEF DESCRIPTION OF THE DRAWINGS

FIG. 15 shows the assembly of all elements comprising a second puzzle embodiment of the present invention, FIGS. 16, 17. 18 and 19 are perspective views of the various elements.

DETAILED DESCRIPTION OF THE PREFERRED EMBODIMENTS

Figure 1:
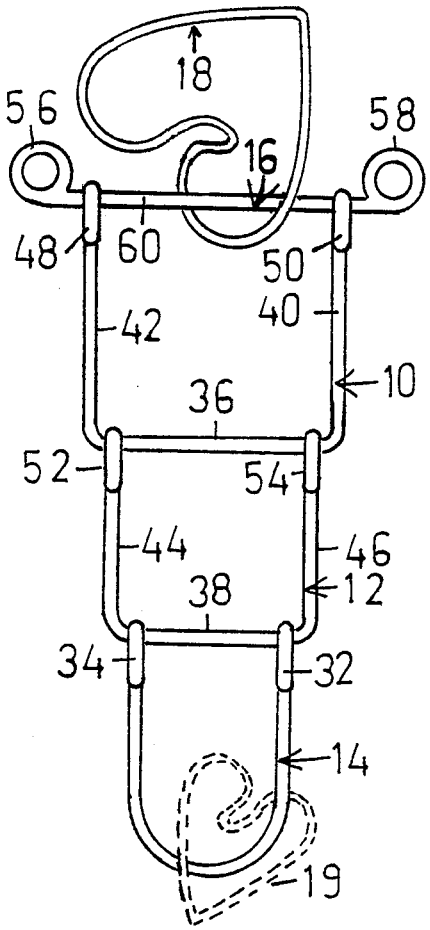
FIG. 1 shows the assembly of all elements comprising a first puzzle of the present invention.

Referring now to FIG. 1 there is shown three U-shaped members 10, 12, 14 and a crossbar 16 interlocked together and a heart-shaped closed loop wire-form solitary game piece element 18 which, in accordance with the present invention, must become engaged consecutively with crossbar 16, elements 10, 12 and finally 14 in order to gain the objective of this puzzle. When heart-shaped element 18 engages U-shaped member 14, as shown by dashed line 19, the puzzle is solved. The contestant solving the puzzle in the shortest time is the winner of the contest. If desired, the object of the puzzle may be extended to moving the heart-shaped element 18 back up to and free from the cross bar 16 in a reversal of steps, and thus free the heart-shaped element 18 from the interlocked members 10, 12, 14 and 16. Details of the shape and construction of the elements will be described with reference to FIGS. 2, 3, 4 and 5.

Figure 2:
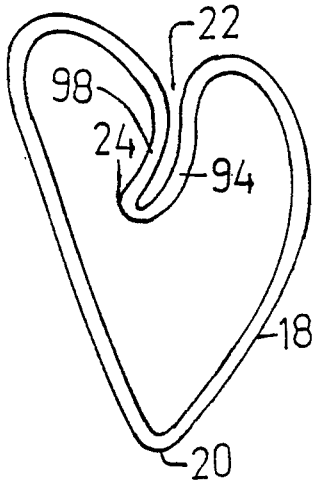
FIG. 2 is a perspective view of the heart-shaped game piece element.

As shown in FIG. 2 the heart-shaped game piece element 18 is formed from a wire, as are all the other members of the puzzle. From the heart apex 20 to the heart throat 22, the wire rib portion remains in a single plane. However, at the throat 22 the wire extends upwardly from the plane to form a loop or tongue 24 with spaced sides, the purpose of which will be understood as the description proceeds.

Figure 3:
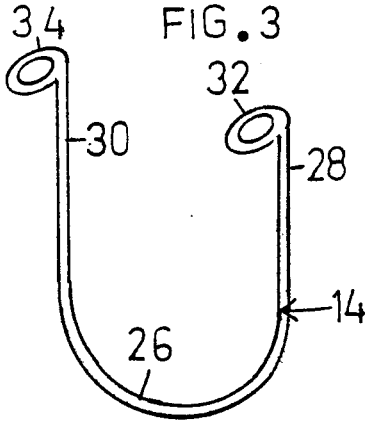
FIG. 3 is a perspective view of the lowermost U-shaped element.

FIG. 3 shows U-shaped member 14 to have a horseshoe configuration with the U-shaped loop 26 having upstanding portions 28,30 terminating in closed loops 32,34 at the top. If desired, the horseshoe-shaped loop 26 may be straight as are the horizontal rungs 36 of the other U-shaped members 10,12, one of which is shown in FIG. 4.

Figure 4:
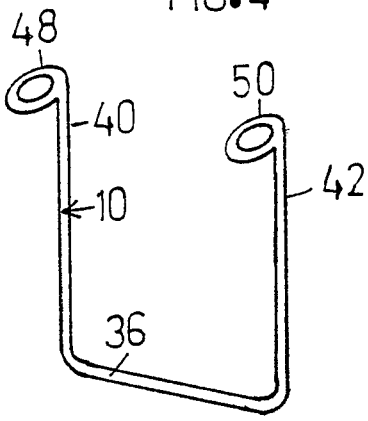
FIG. 4 is a perspective view of one of the intermediate elements.

The U-shaped member 10 in FIG. 4 is also substantially like U-shaped member 12 in FIG. 1. The length of horizontal rung 36 on member 10 is substantially the same length as rung 38 on member 12. Upstanding portions 40,42 on member 10, and upstanding portions 44,46 on member 12 in FIG. 1, also are preferably the same length as rungs 36,38 to form three sides of a square by each member. Loops 48,50 terminate the upper ends of the upstanding portions 40,42 of member 10, and loops 52,54 terminate the upper ends of upstanding portions 44,46 of member 12.

Figure 5:
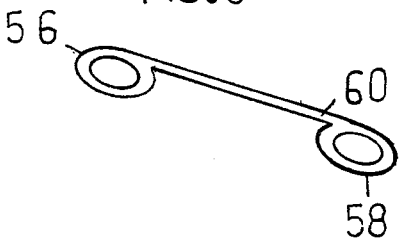
FIG. 5 is a perspective view of the crossbar.

In FIG. 5, crossbar 16 is shown with loops 56,58 at the ends of horizontal portion 60. It should be noted that these loops 56,58 are slightly larger than loops 48,50 of U-shaped member 10 to maintain their assembly as shown in FIG. 1.

Figure 6:
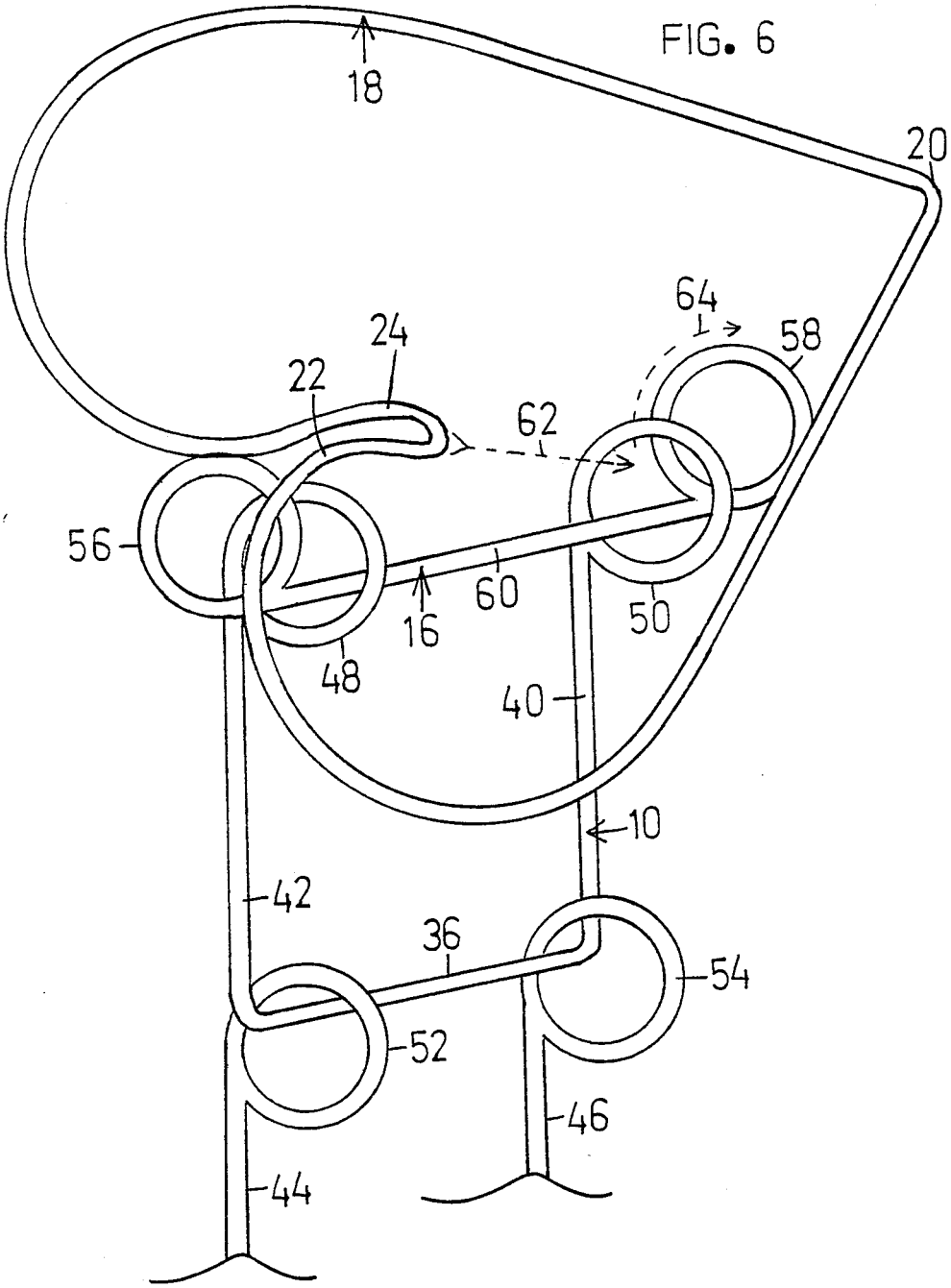
FIGS. 6–14 are sequential views showing the relationship of the various parts in the steps required in solving the puzzle.
Figure 7:
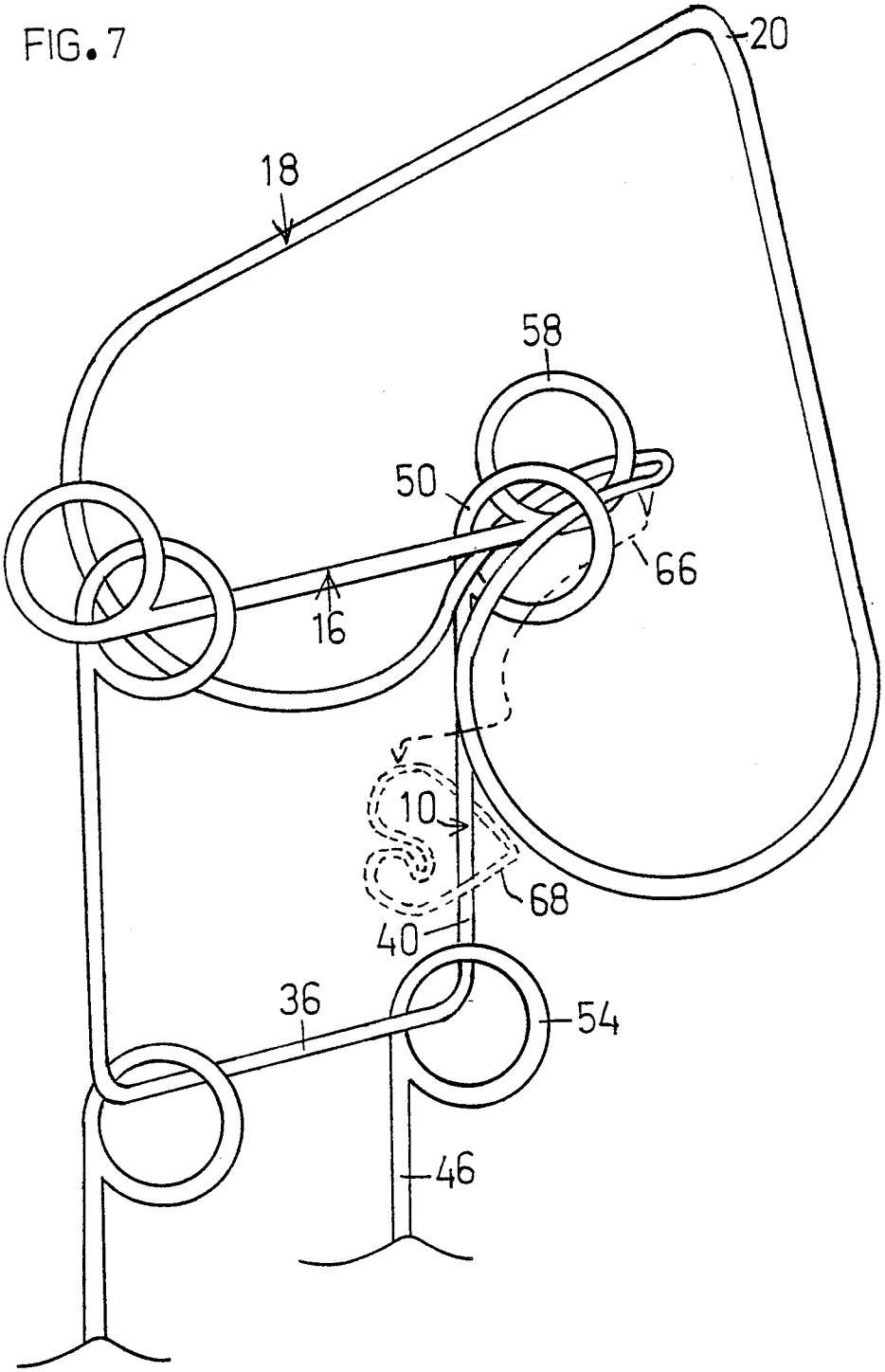

FIG. 6 is an enlarged view of a portion of the structure in FIG. 1 wherein the heart-shaped element 18 is free from attachment to any of the interlocked elements 10,12,14,16 and the puzzle is ready to be solved. FIG. 6 shows an arrow 62 which is the path of the first step. The tongue 24 of heart element 18 is passed through loop 50 on U-shaped member 10. This step is followed by passing the spaced sides of tongue 14 over loop 58 as indicated by arrow 64. The result of these steps is shown in FIG. 7. The arrow 66 in FIG. 7 indicates that the spaced sides of tongue 24 are passed down over loop 58 and withdrawn back through loop 50 to place the heart element 18 around portion 40 of member 10 as shown in dashed lines 68.

Figure 8:
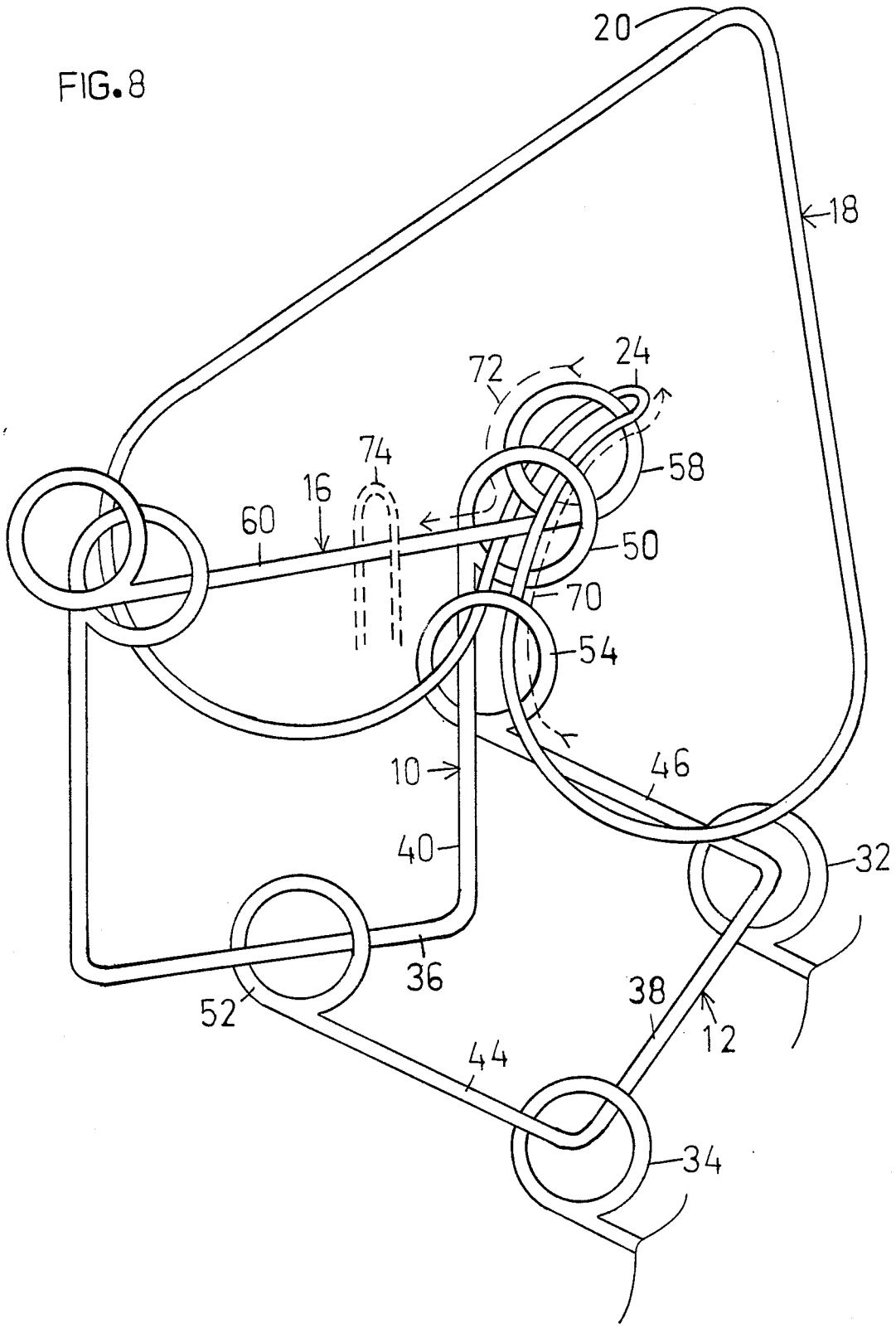

From the position of heart element 18 shown in dashed line 68 in FIG. 7, the next step or placement of tongue 24 is shown in FIG. 8. As shown by arrow 70 the tongue 24 is passed through loop 54 on member 12, then through loop 50 on member 10. The spaced sides of tongue 24 are then passed up on both sides of loop 58 on crossbar 16 to the position shown in the drawing. The next step is to pass tongue 24 up and over loop 58 and follow arrow 72 back out of loop 50 and straddling horizontal portion 60 of crossbar 16. This position of tongue 24 is shown by dashed line 74 in FIG. 8. Note that the tongue 24 is still extended through loop 54 on member 12.

Figure 9:
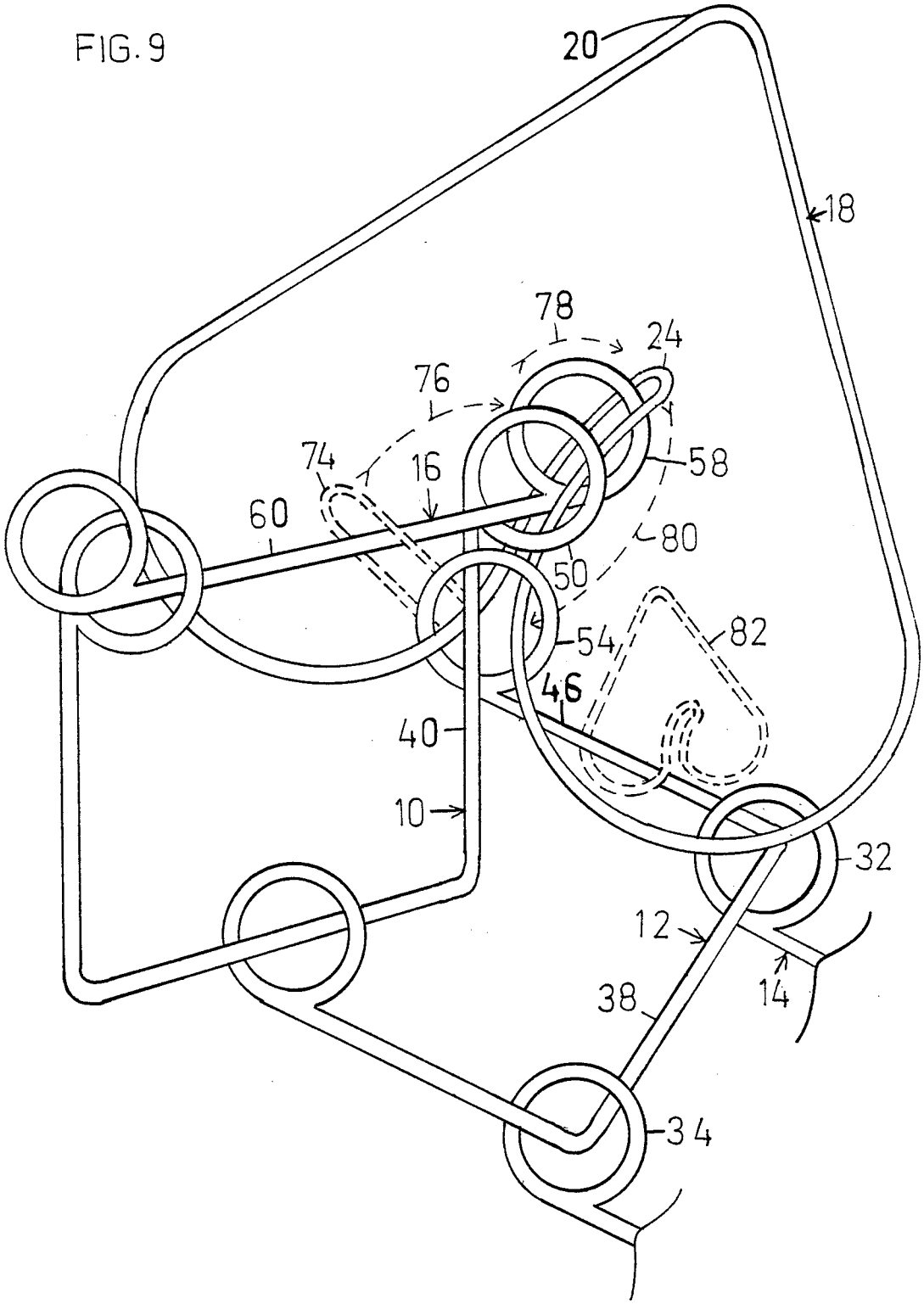

Dashed line 74 is repeated in FIG. 9. Tongue 24 is now passed up and over loop 50 in a straddling position, following arrow 76. Tongue 24 is then passed up and over loop 58 in a straddling position, following arrow 78, to its position shown in FIG. 9. From the position of tongue 24 shown in FIG. 9, the tongue is moved following arrow 80. Thus, tongue 24 clears loop 58 downwardly and both spaced sides of the tongue passes free of loop 50 and to the right of it. Further downward movement causes tongue 24 to pass back out of loop 54. This places the heart element 18 onto upstanding portion 46 of U-shaped member 12 as shown in FIG. 9 by dashed line 82.

Figure 10:
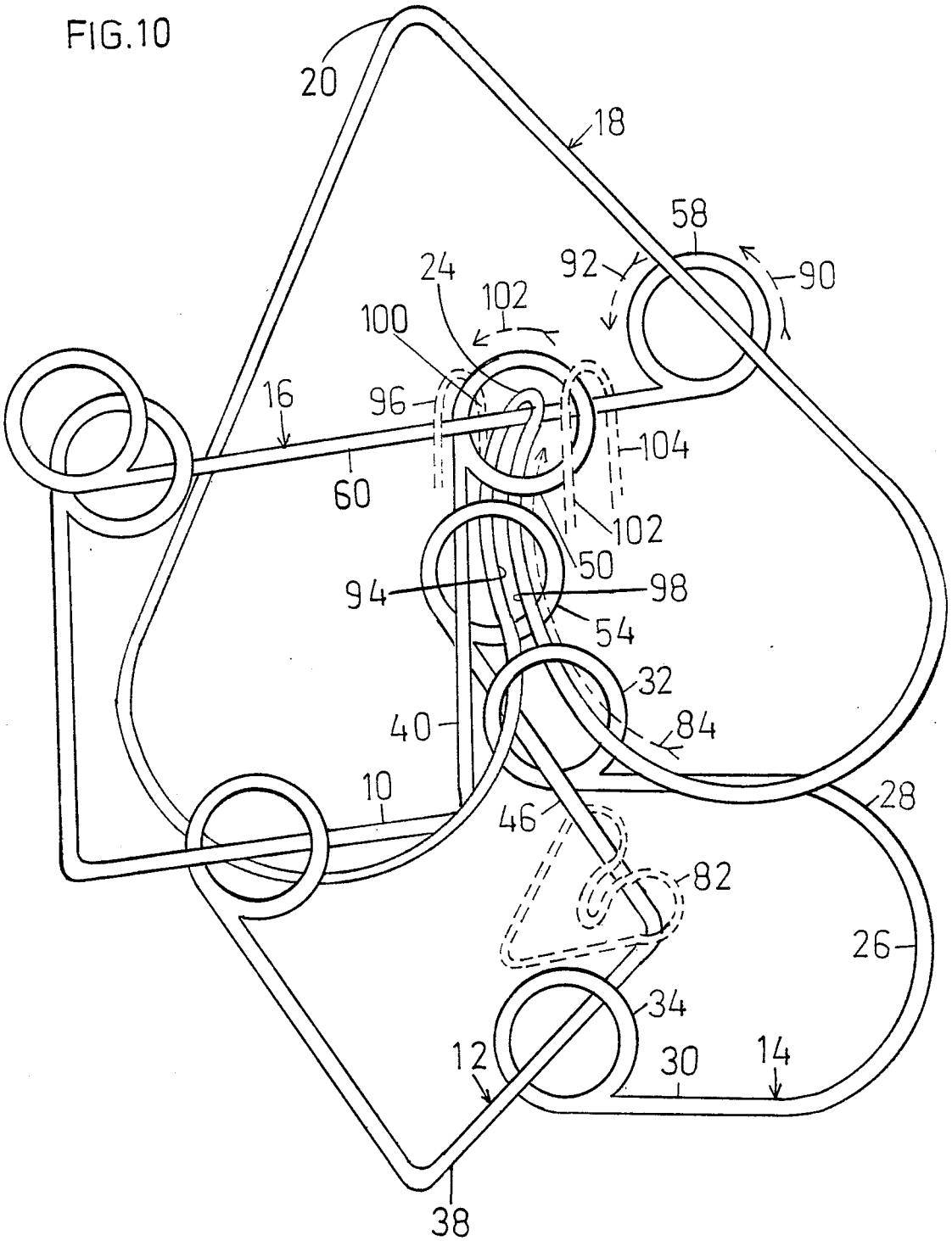

Having looped the heart element 18 over portion 46 of U-shaped member 12, as shown in dashed line 82, the next and last stage in solving the puzzle is to free it from member 12 and loop it over member 14. Dashed line 82 in FIG. 9 is reproduced in FIG. 10. FIG. 10 shows the midpoint of the several steps required to free hart element 18 from member 12 and place it onto member 14 to conclude the puzzle. FIG. 10 shows how tongue 24 is moved up through the loops 32 and 54, avoiding loop 50 and straddling loop 58 in an upward direction as shown by arrows 84 and 90. After straddling loop 58 with the spaced sides of tongue 24, tongue 24 is moved over loop 58 in the direction of arrow 92. At this point tongue 24 straddles horizontal portion 60 of crossbar 16 but to the right of loop 50, as shown.

Figure 11:
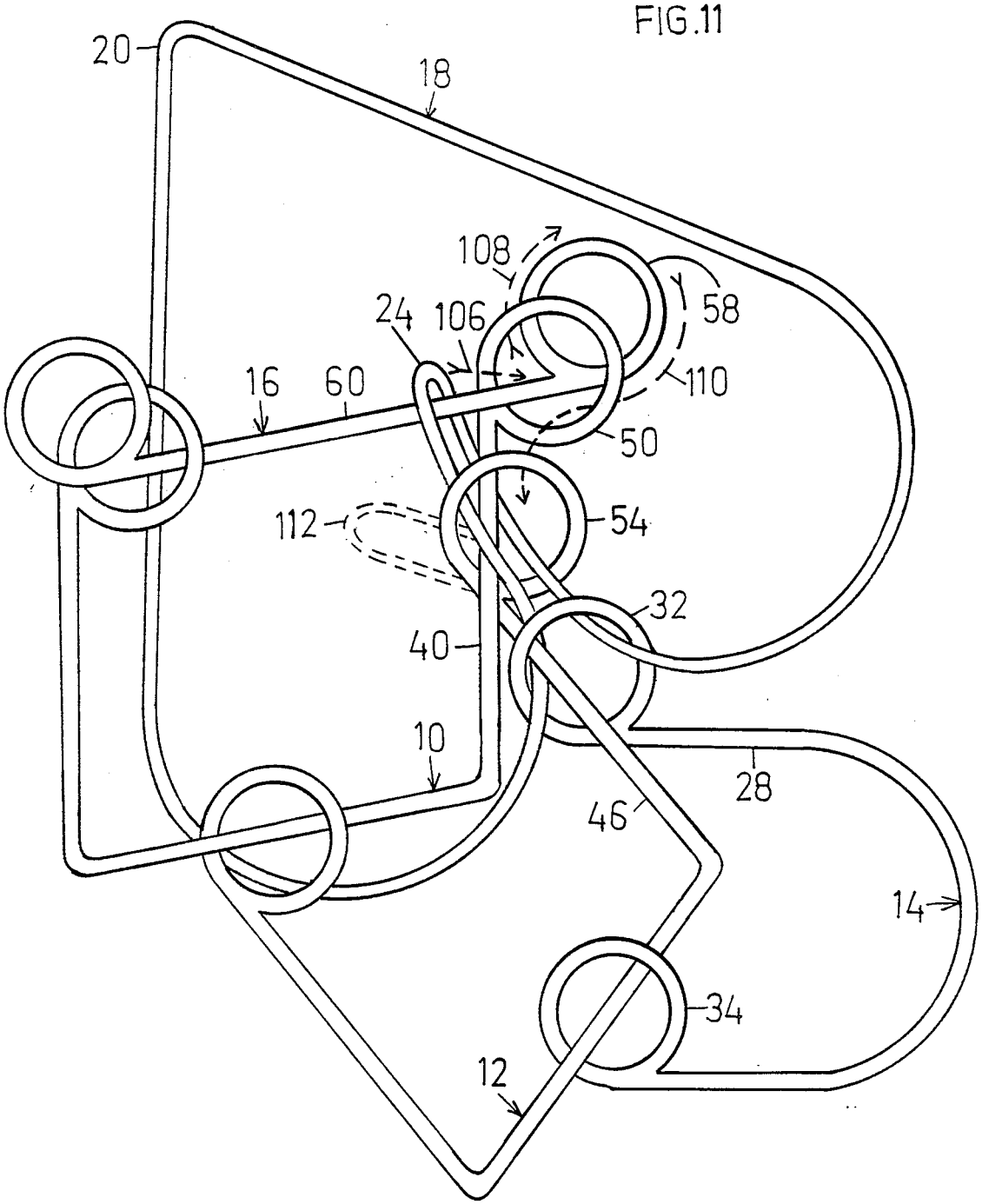

To continue with the unlocking of heart element 18 from U-shaped member 12, it is necessary that tongue 24 be moved on horizontal portion 60 of crossbar 16 from the right to the left of loop 50, as shown in FIG. 11. This is done in FIG. 10 by moving tongue 24 so that its side 94 is moved to dashed line 96 and tongue side 98 is moved to dashed line 100. From this position tongue 24 follows arrow 102 in an up and over movement straddling loop 50. (Note that tongue 24 still straddles horizontal portion 60 of crossbar 16.) Side 94 of tongue 24 is now at dashed line 102 and side 98 is at dashed line 104. This, then, positions tongue 24 as shown in FIG. 11 to free itself from loops 58 and 50 in order that it may continue to release itself from member 12 and engage member 14. From the position in FIG. 11, tongue 24 on horizontal portion 60 of crossbar 16 is passed through loop 50 as shown by arrow 106. Tongue 24 is then straddled up and over loop 58 as shown by arrow 108 and withdrawn from loop 50 and loop 54 as shown by arrow 110 to its position shown by dashed line 112. Tongue 24 is shown in this position in FIG. 12.

Figure 12:
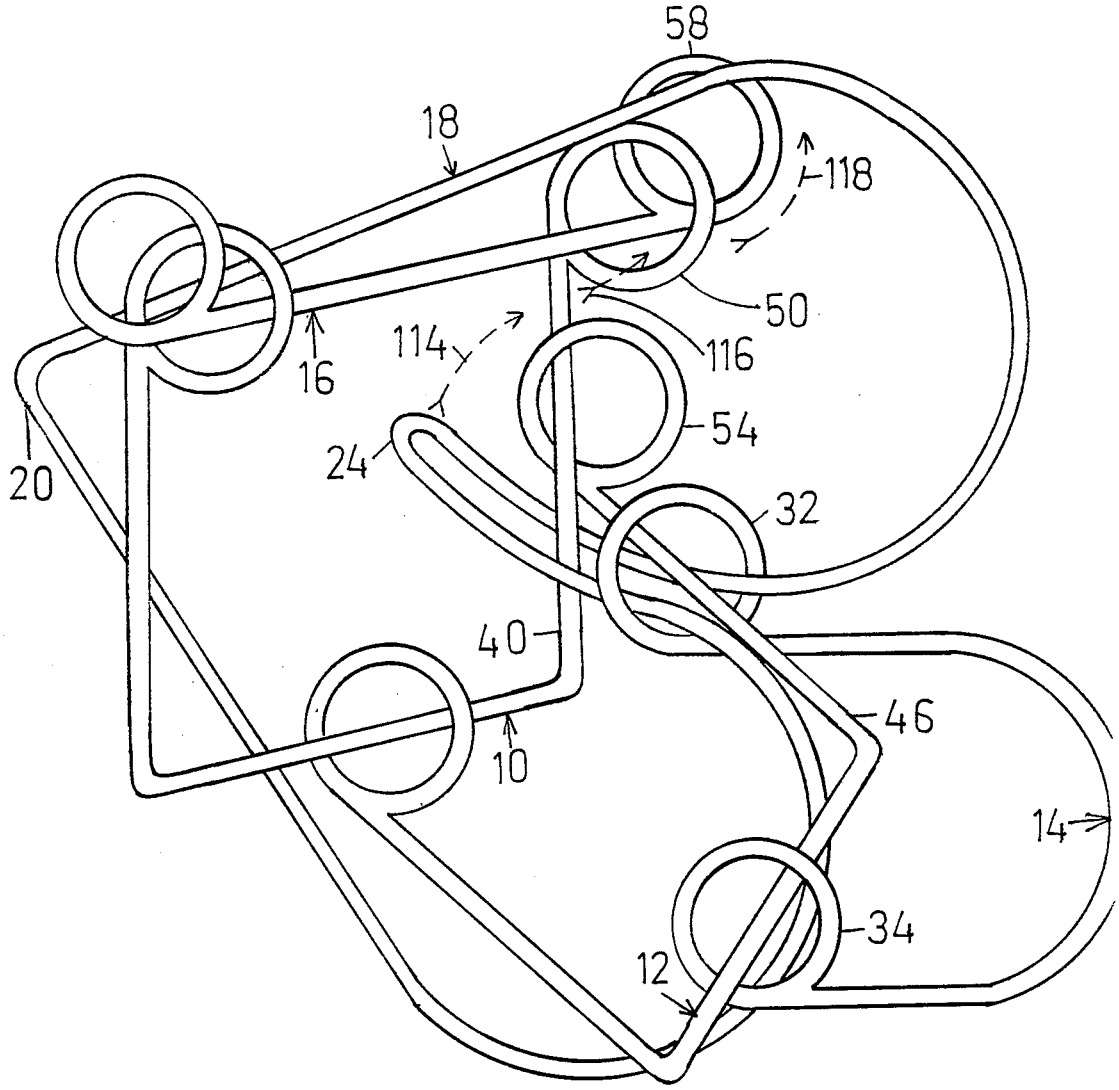

Note that in FIG. 12 tongue 24 still straddles upstanding portion 40 of U-shaped member 10 and straddles upstanding portion 46 of U-shaped member 12. Both sides of tongue 24 pass through loop 32 of U-shaped member 14. From the position of tongue 24 in FIG. 12, the tongue is twisted around loop 54 as shown by arrow 114. It then follows arrow 116 through loop 50 and follows arrow 118 to straddle loop 58. This position is shown in FIG. 13.

Figure 13:
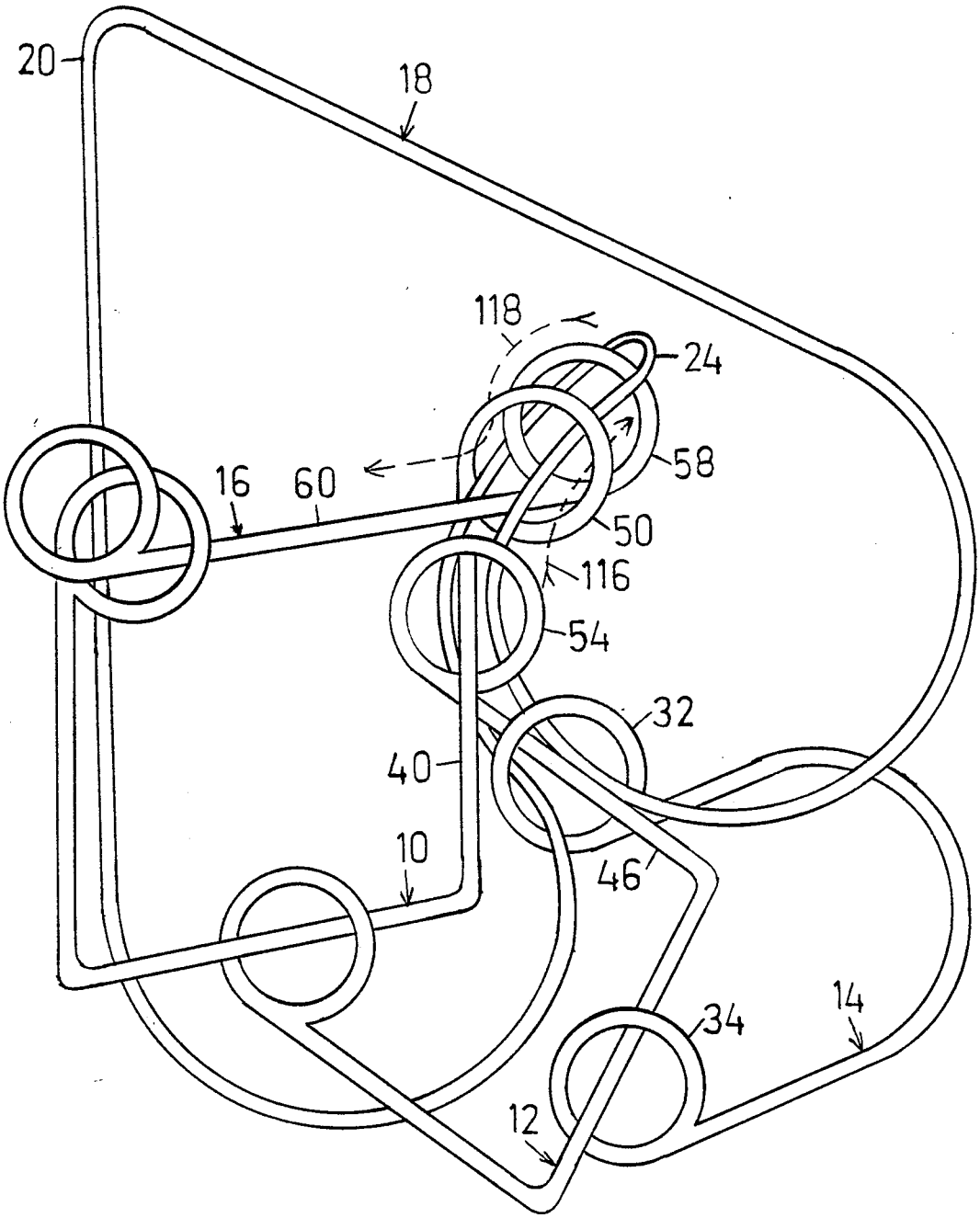

From the position of tongue 24 in FIG. 13, the tongue follows arrow 118 around loop 58 and back through loop 50. It still remains straddled over horizontal portion 60 of crossbar 16 a shown in FIG. 14.

Figure 14:
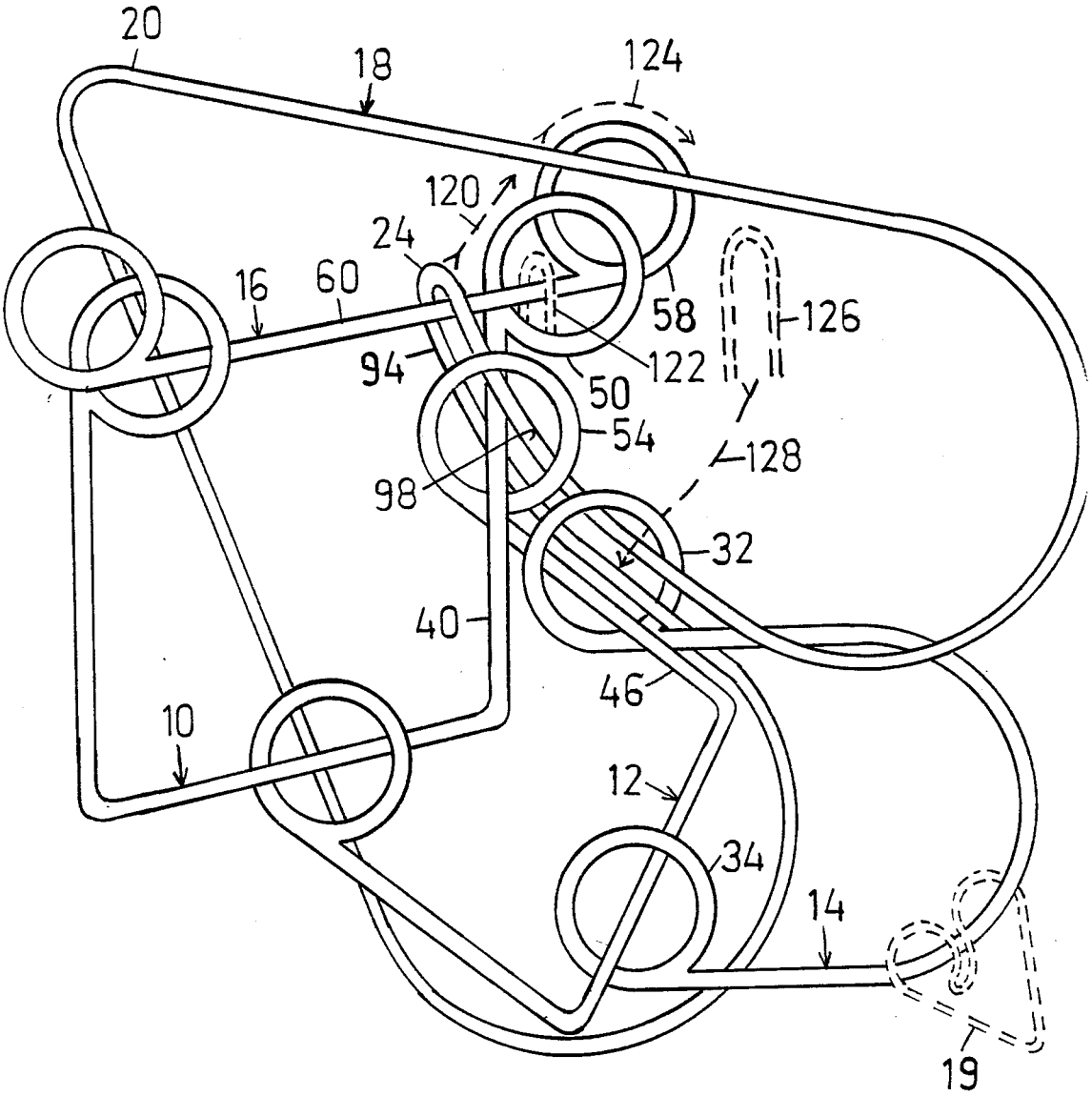

From the position of tongue 24 in FIG. 14, the tongue is moved in the direction of arrow 120 so that it straddles loop 50 with tongue side 94 on the far side of loop 50 and side 98 is on the near side of the loop. Tongue 24 continues to move over loop 50 until it is free and clear of it as shown by dashed line 122. From the position of tongue 24 at dashed line 122, the tongue is then passed over loop 58 as shown by arrow 124 and is freed from it. Dashed line 126 shows this position.

Tongue 24 is then pushed down backwards through loop 32 as shown by arrow 128 to free it from loop 32. When this occurs the heart-shaped element 18 drops down onto U-shaped member 14 as shown by the dashed line 19. At this point the puzzle is solved.

A reversal of the steps described will cause the heart-shaped element to be moved sequentially from member 14 to member 12 to member 10 to crossbar 16 and finally free from them all. If desired, the reversal of steps and freeing element 18 from the other members can be included in the criteria for solving the puzzle.

DETAILED DESCRIPTION OF SECOND EMBODIMENT

After the puzzle solver has mastered the first embodiment puzzle, the more difficult puzzle of the second embodiment may be attempted. As before, the object is to move heart 18 to the bottom element 14 where it is shown by dashed line 191. The second embodiment of the puzzle is shown in FIGS. 15–19. In most instances the parts are the same as in the first embodiment and will be referred to with the same numerals. Additional elements are identified with an extra digit. For example, an extra U-shaped element 10 is identified as U-shaped element 101. An extra crossbar 16 is identified as crossbar 161. The horizontal portion 601 is slightly shorter than horizontal portion 60 of crossbar 16 so that its end loops 561,581 are positioned around the upstanding portions 401 and 421 of U-shaped element 101.

The difference between the first embodiment shown in FIG. 1 and the second embodiment shown in FIG. 15 is the addition of U-shaped element 101 and crossbar 161 shown in FIG. 19. U-shaped element 101 is positioned through loops 48,50 of U-shaped element 10 and crossbar 16 is positioned through loops 481 and 501 of U-shaped element 101.

Figure 20:
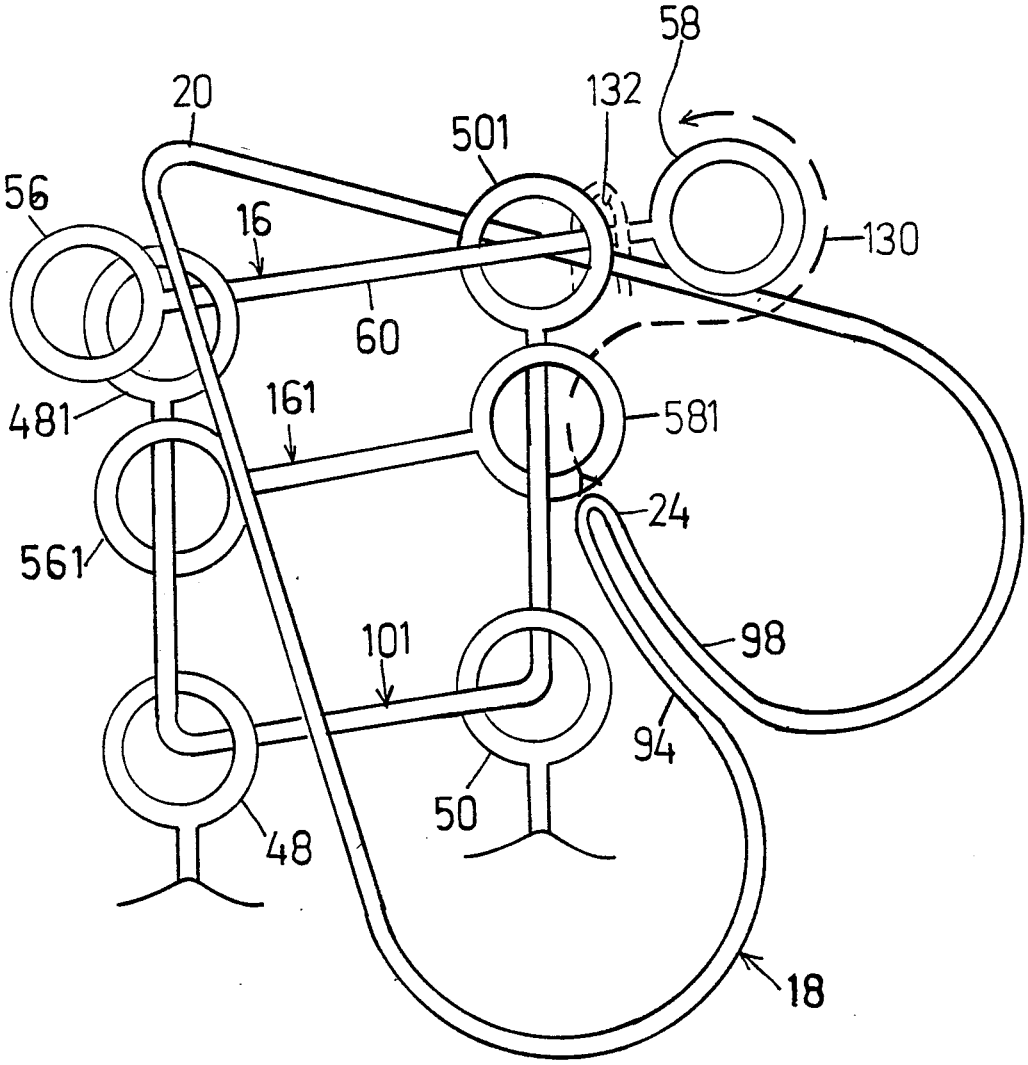
FIGS. 20–37 are sequential views showing the relationship of the various parts in the steps required in solving the second puzzle.
Figure 21:
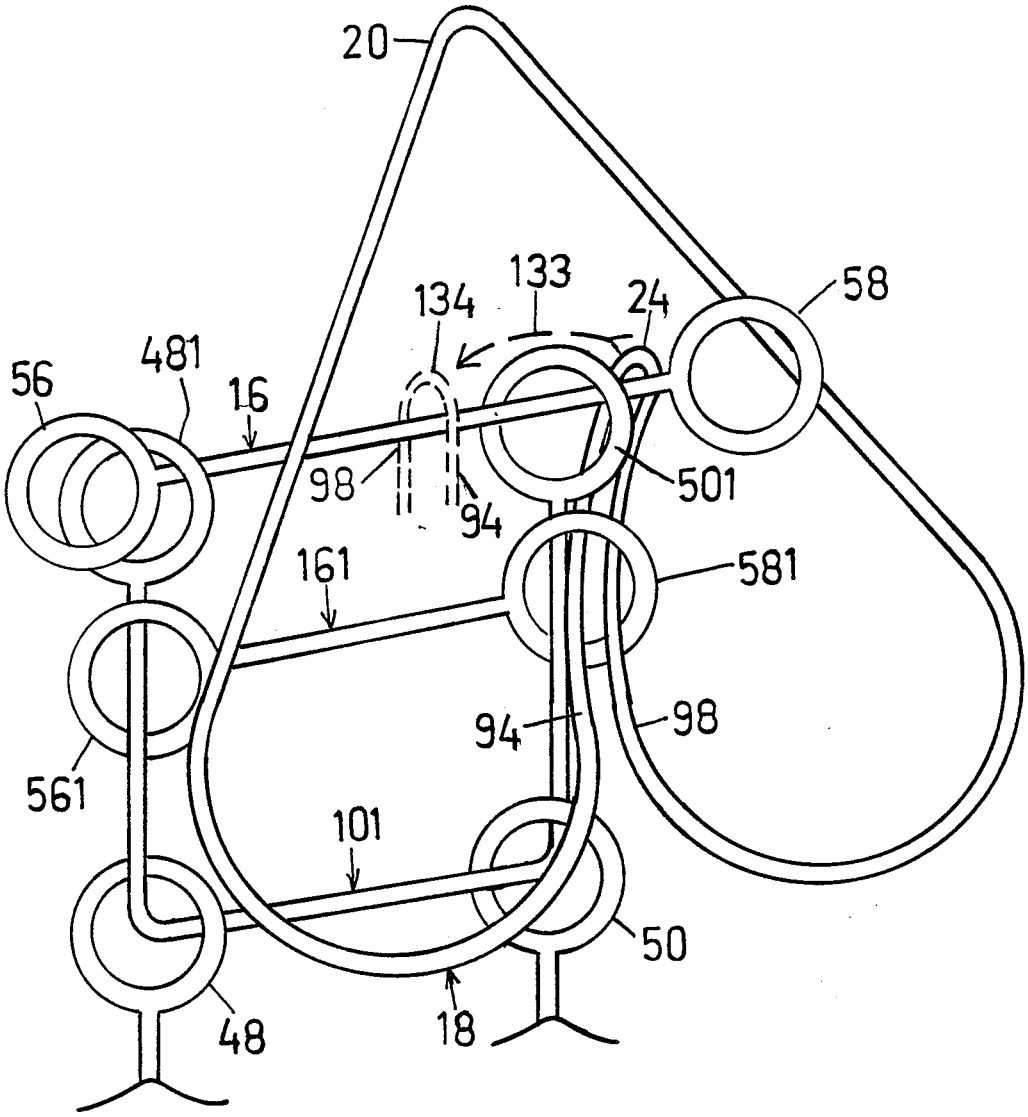
Figure 22:
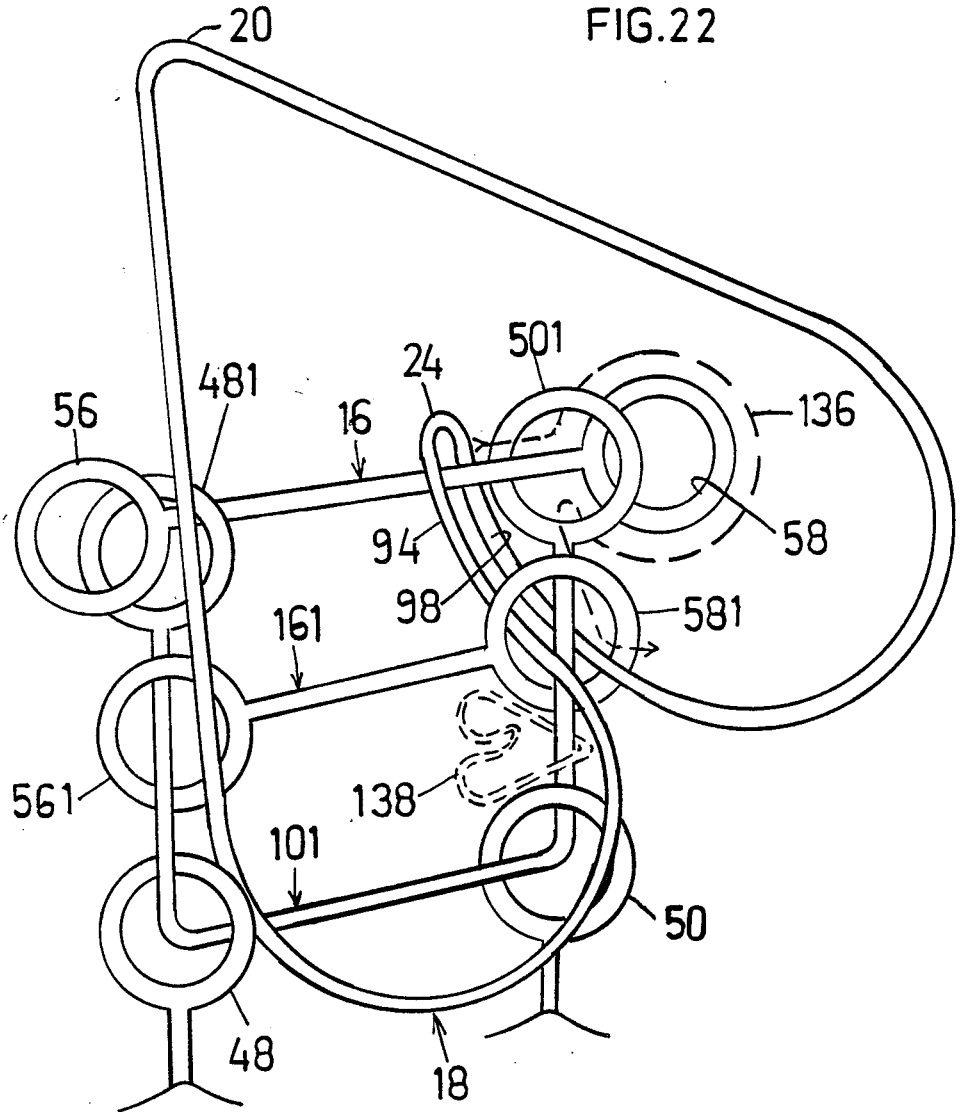
Figure 23:
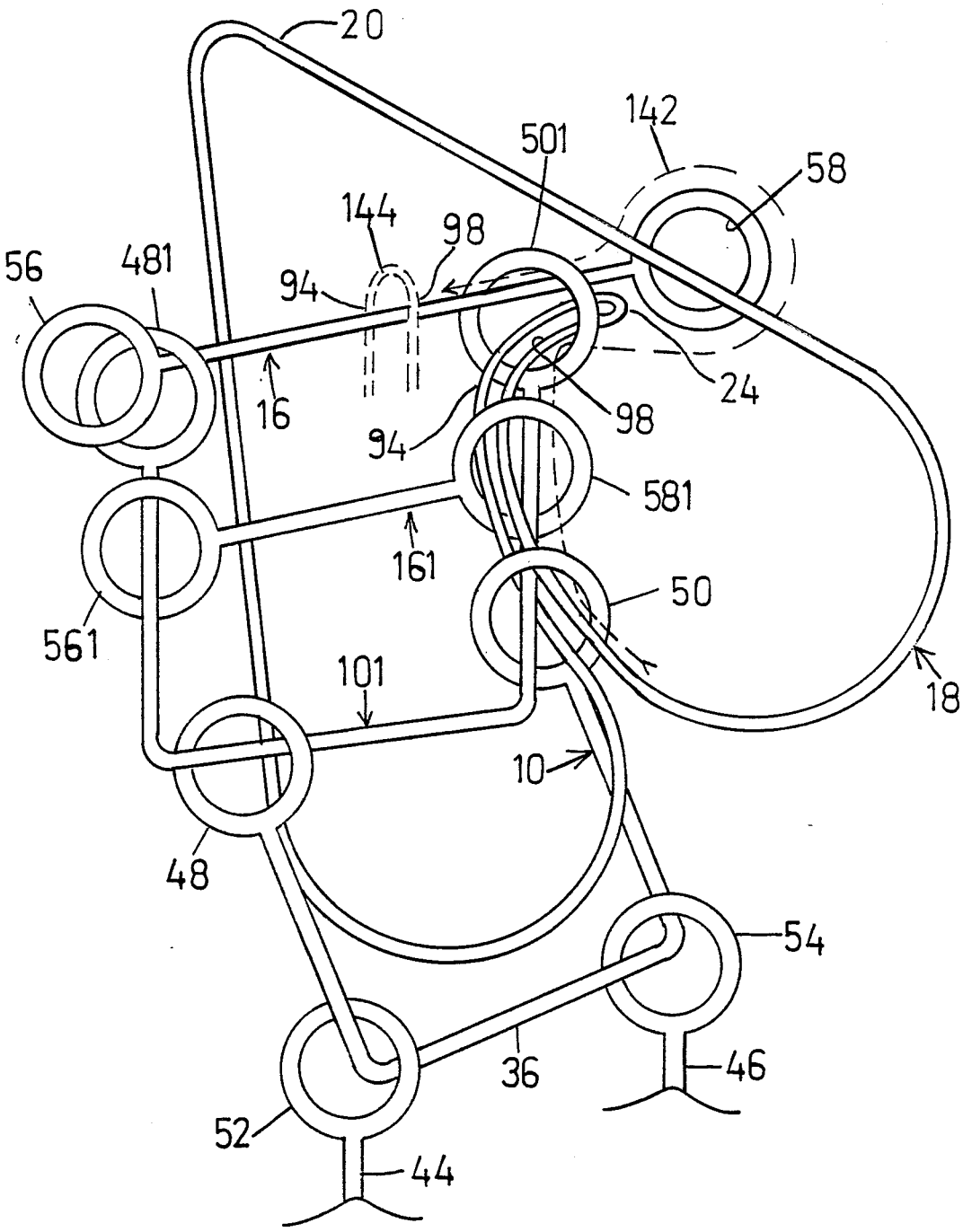

The steps in solving the puzzle of the second embodiment are set forth in FIGS. 20–37. These steps are not the same as those for the first embodiment. In FIG. 20 the heart-shaped element 18 is free from all other structure at the commencement of solving the puzzle. Tongue 24 of element 18 follows dashed line 130 through loop 581 of crossbar 161. It then straddles up over loop 58 of crossbar 16 to the position shown by dashed line 132. From this position, which is shown in FIG. 21, sides 94,98 of tongue 24 are straddled up and over loop 501, following arrow 133 too dashed line position 134. This dashed line position 134 is the position of tongue 24 in FIG. 22. In FIG. 22 tongue 24 follows dashed line arrow 136 through loop 501 and straddles up and over loop 58 to free it from crossbar 16. It continue back through loop 501 which frees it from crossbar 16. It then continues back out of loop 581 to free it from crossbar 161 and it assumes the position of the dashed line heart 138 where it is still connected to element 101. The heart 18 is free of both crossbars 16 and 161.

Figure 24:
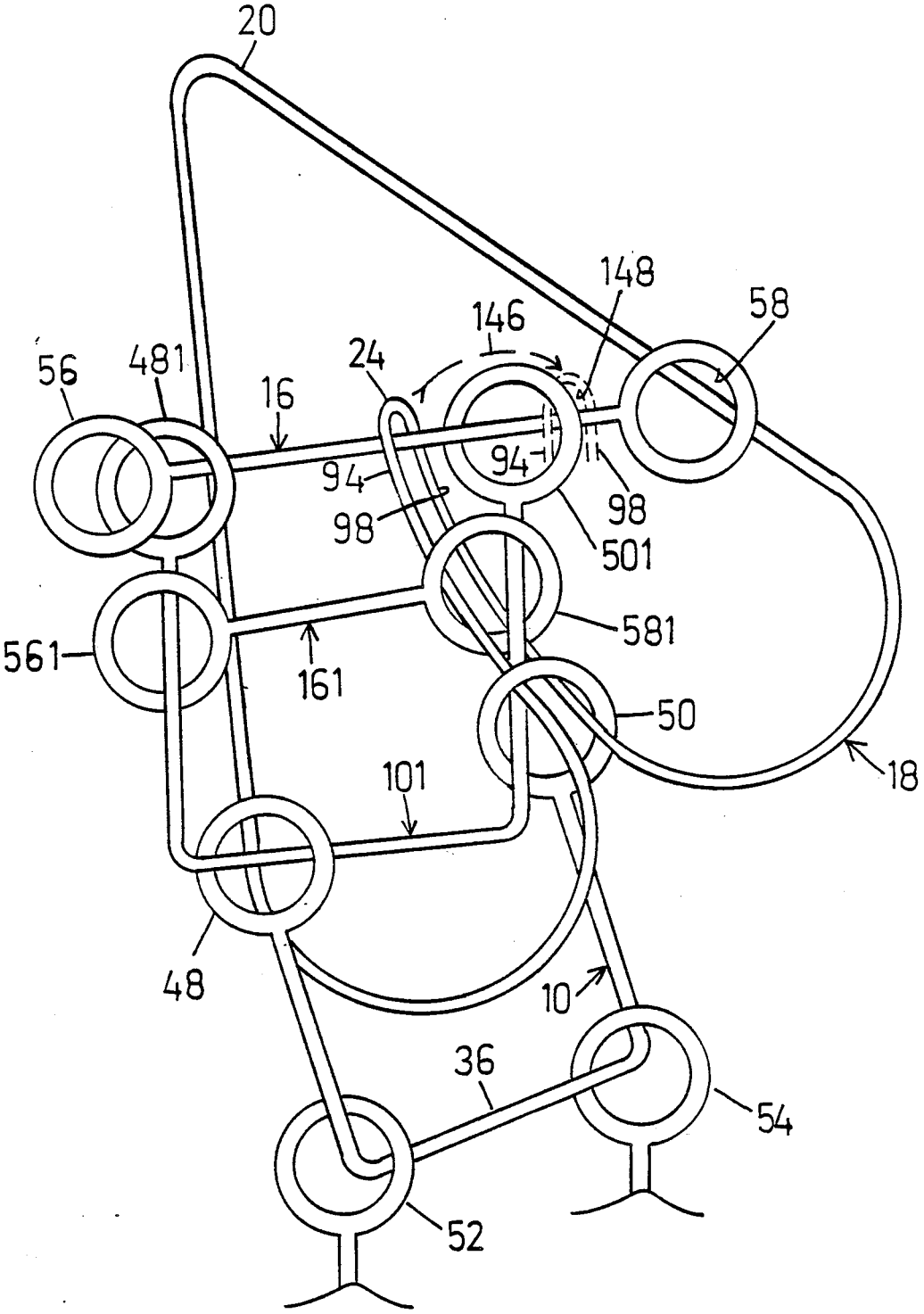
Figure 25:
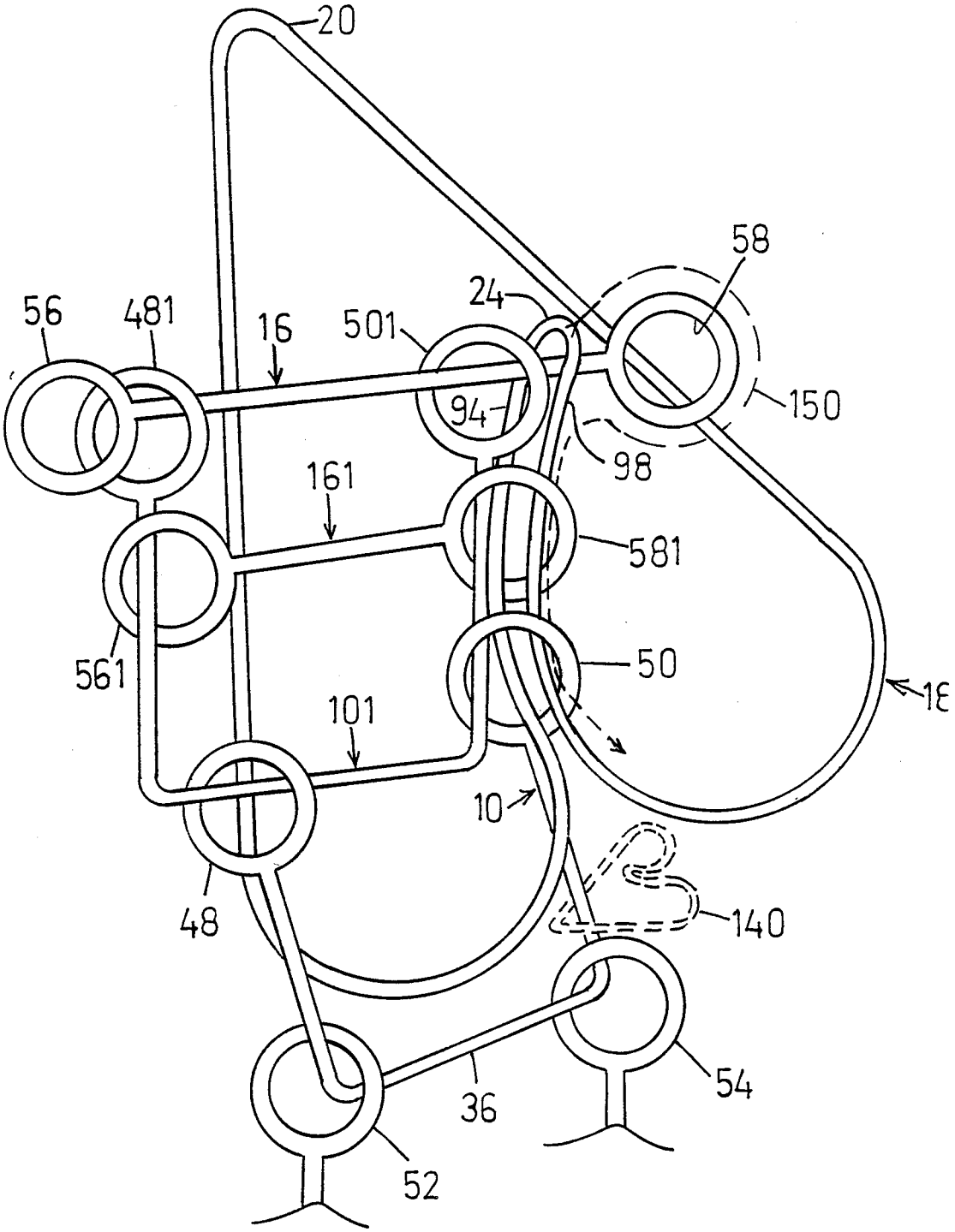
Figure 26:
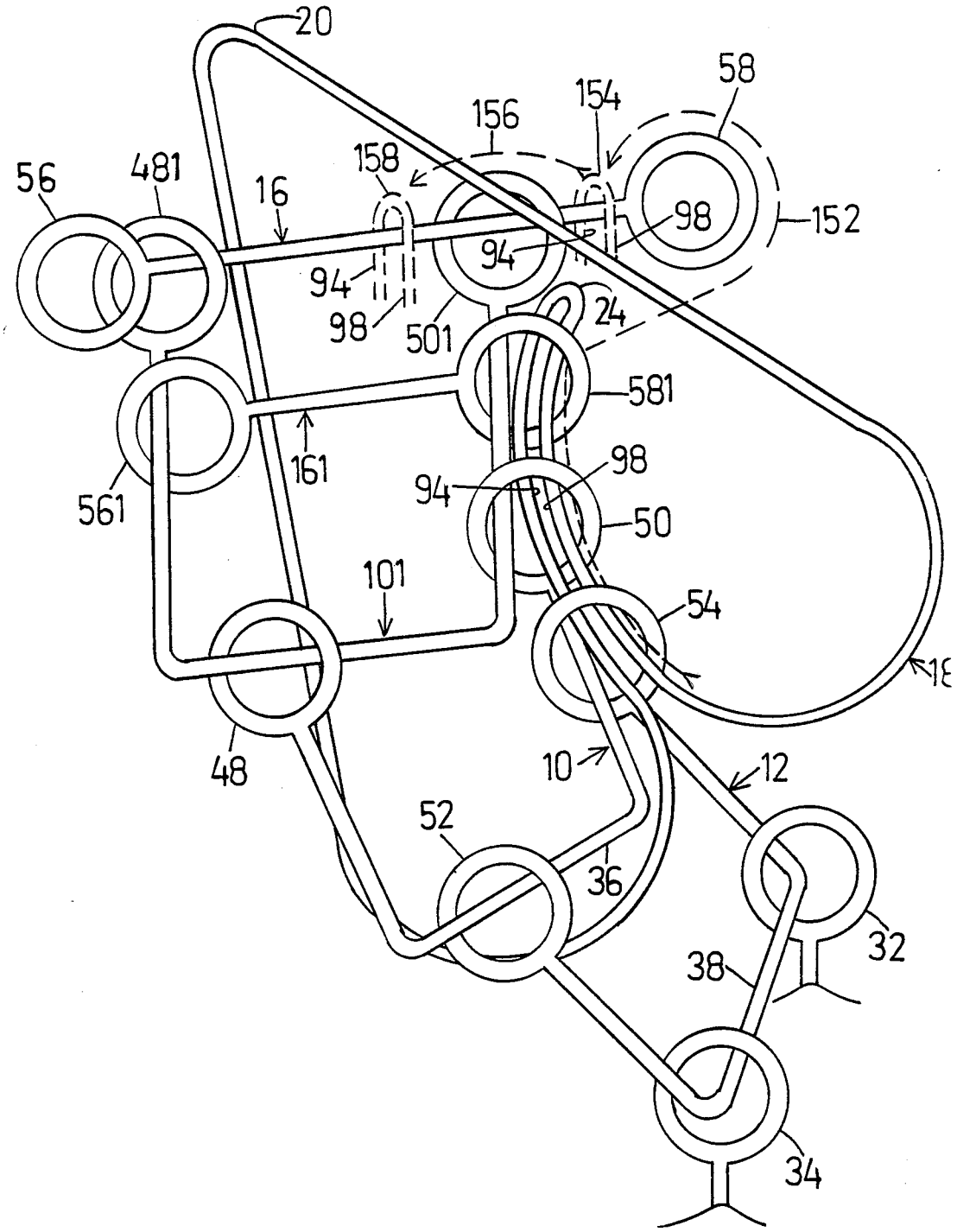

The next step is to free heart 18 from element 101 and leave it connected to element 10, shown by heart dashed line 140 in FIG. 25. From heart position 138 in FIG.22 tongue 24 is passed through loop 50 of element 10, following arrow 142 in FIG. 23, through loop 581 of crossbar 161, through loop 501 of element 101 to the position shown in FIG. 23. From this position tongue 24 is straddled up and over loop 58 and pulled back through loop 501 to straddle crossbar 16 as shown by dashed line 144. This position is also as shown in FIG. 24. When tongue 24 follows arrow 146 to straddle up and over loop 501 it it positioned as shown by dashed line 148 in FIG. 24. This position is also shown in FIG. 25.

From the position in FIG. 25, tongue 24 straddles up and over loops 58 to free it from crossbar 16. It then follows arrow 150 back through loop 581 and is free from crossbar 161. As it continues to follow arrow 150 back out of loop 50 it remains on element 10 as shown by heart dashed line 140. The next step is to move the heart 18 to dashed line 162 in FIG. 29 and free it from element 10. From the position in FIG. 25, tongue 24 is dropped to pass through loop 54. It then follows arrow 152 through loop 50 and loop 581 to the position shown in FIG. 26. It then straddles up and over loop 58 to the dashed line position 154. From this position tongue 24 follows arrow 156 to straddle over loop 501 to dashed line 158. This position of tongue 24 on crossbar 16 is shown in FIG. 27.

Figure 27:
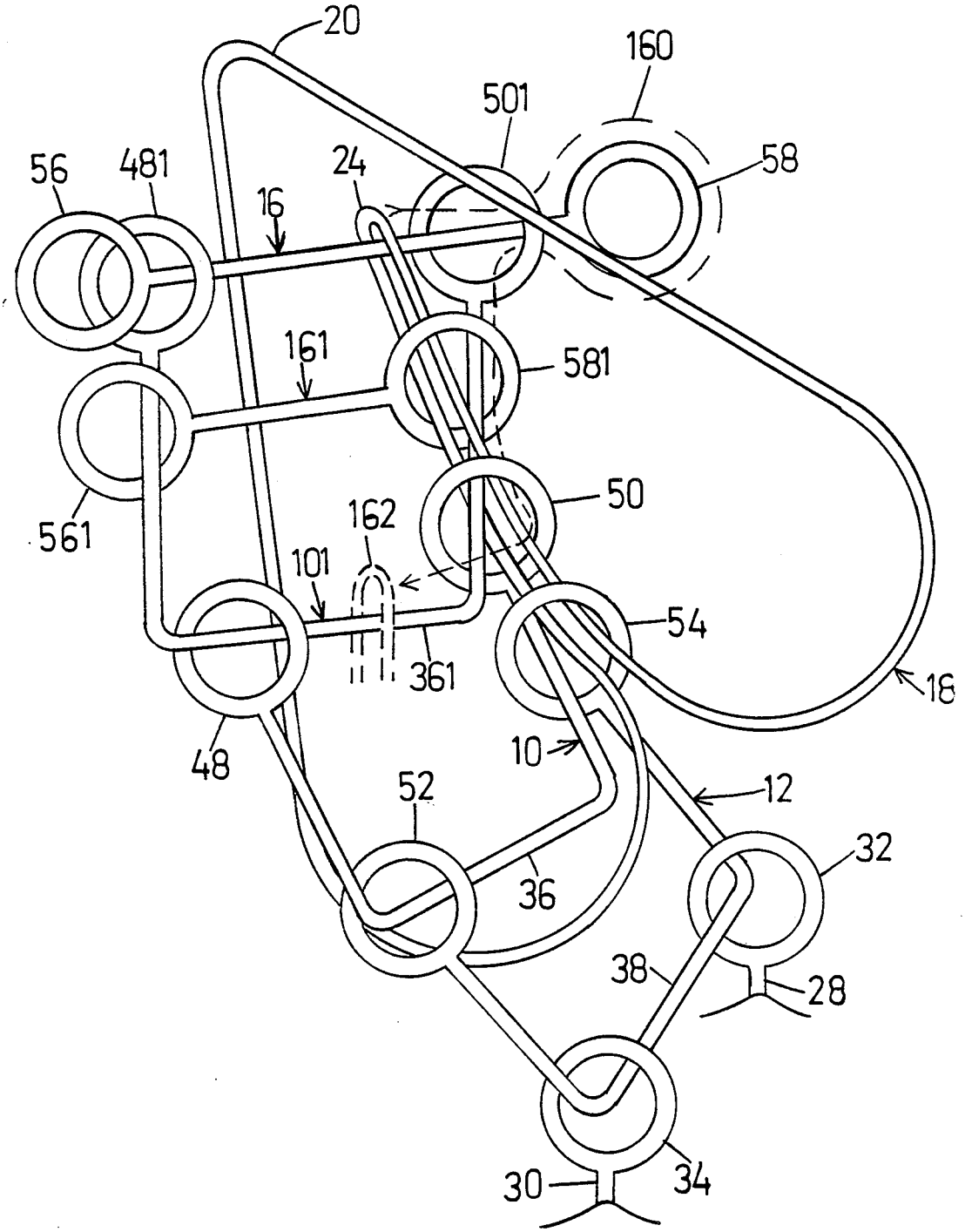
Figure 28:
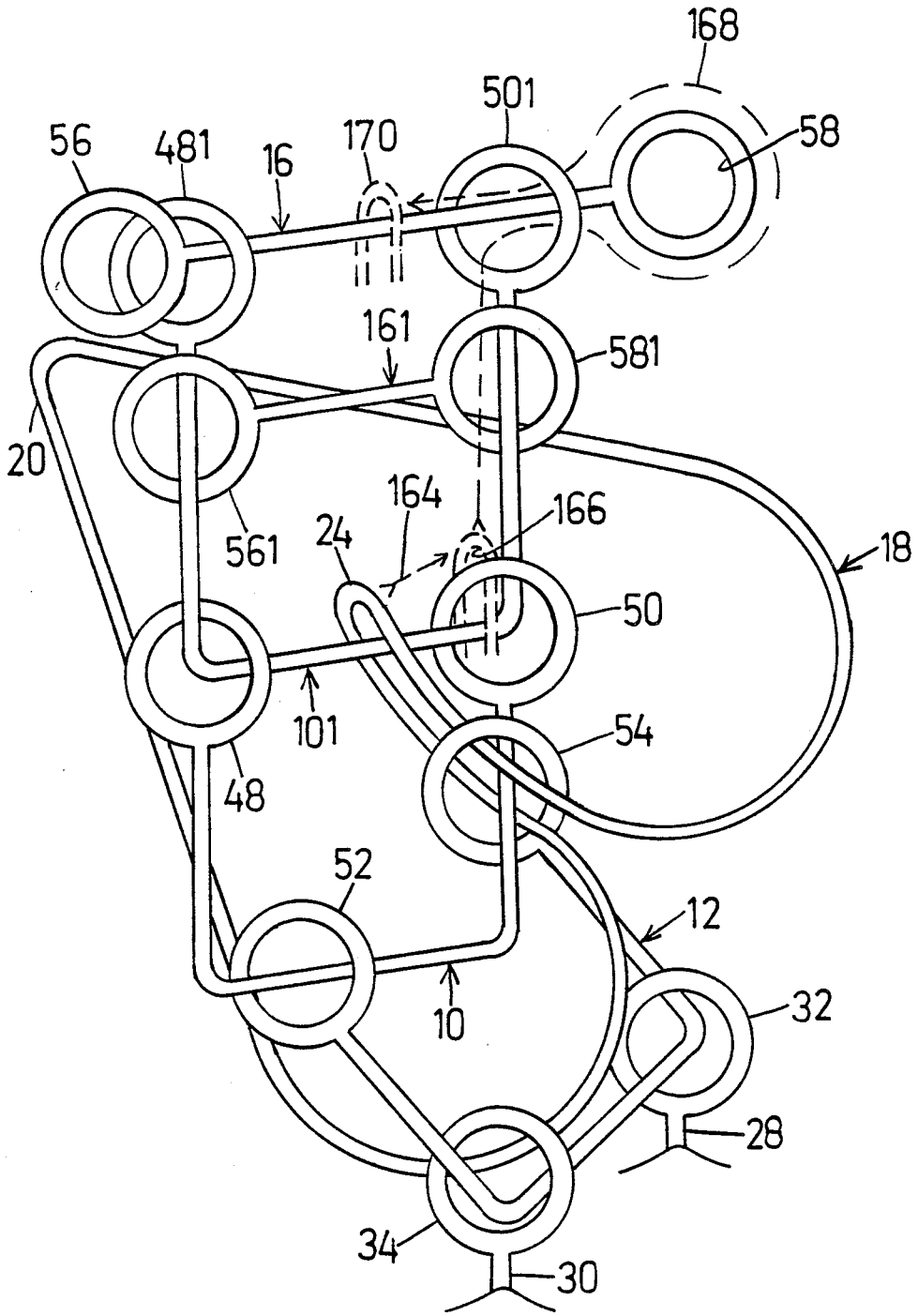
Figure 29:
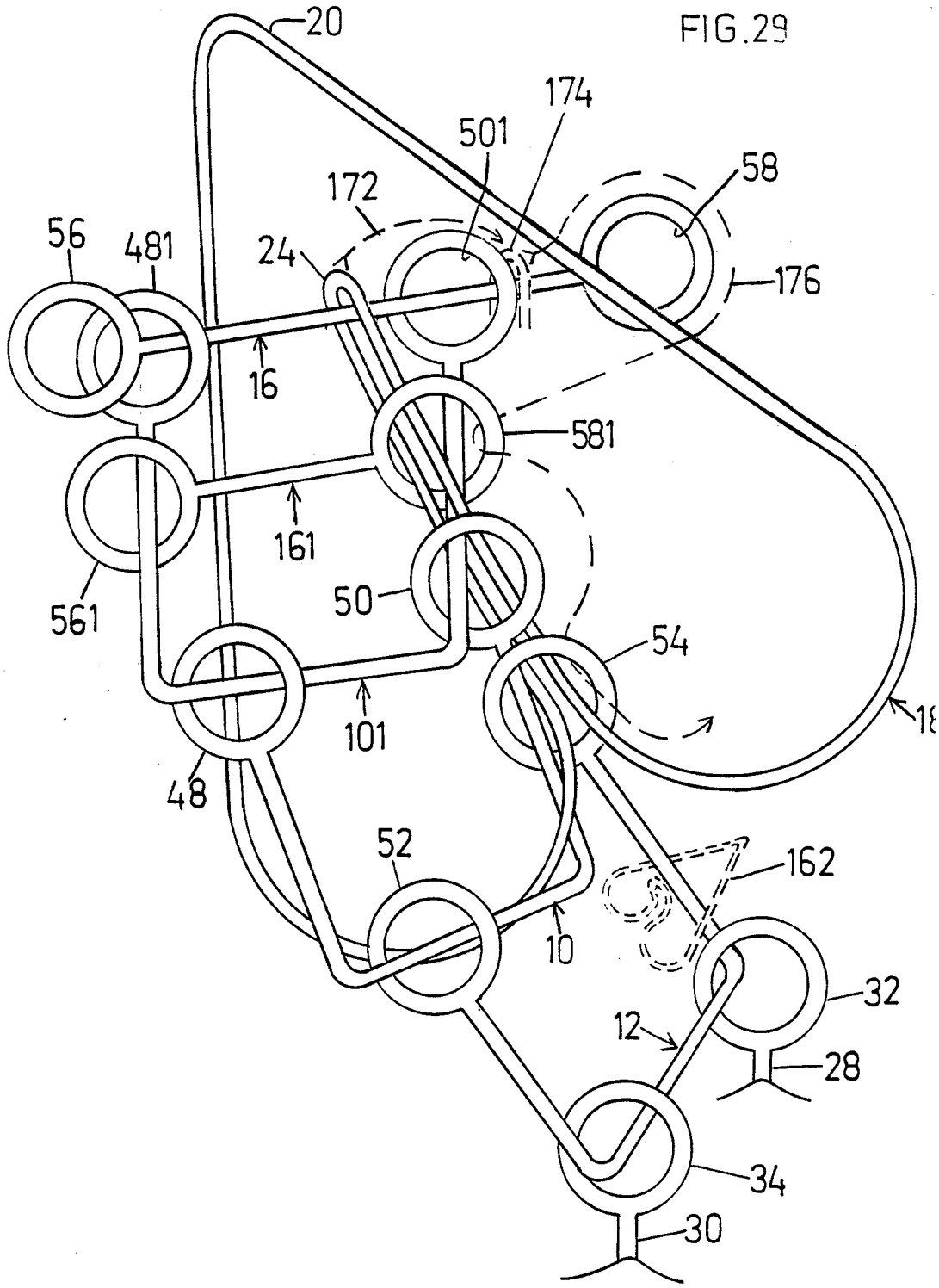

From its position in FIG. 27, tongue 24 follows dashed arrow 160 through 501 to straddle up and over loop 58, back out of loop 501, out of loop 581, out of loop 50 and onto rung 361 of element 101. This position is shown by dashed line 162 in FIG. 27. This position of tongue 24 is also as shown in FIG. 28. In FIG. 28, tongue 24 follows arrow 164 to straddle up and over loop 50 to dashed line position 166. Tongue 24 then follows arrow 168 through loop 581, loop 501, straddles up and over loop 58 and back out of loop 501 to dashed line position 170 over crossbar 16 as shown in FIG. 28. This position of tongue 24 is also shown in FIG. 29. From this position, tongue 24 follows arrow 172 to straddle up and over loop 501 to dashed line position 174. From this position tongue 24 straddles up and over loop 58, following arrow 176, back out from loop 581 and loop 54 to position 162 on element 12.

Figure 30:
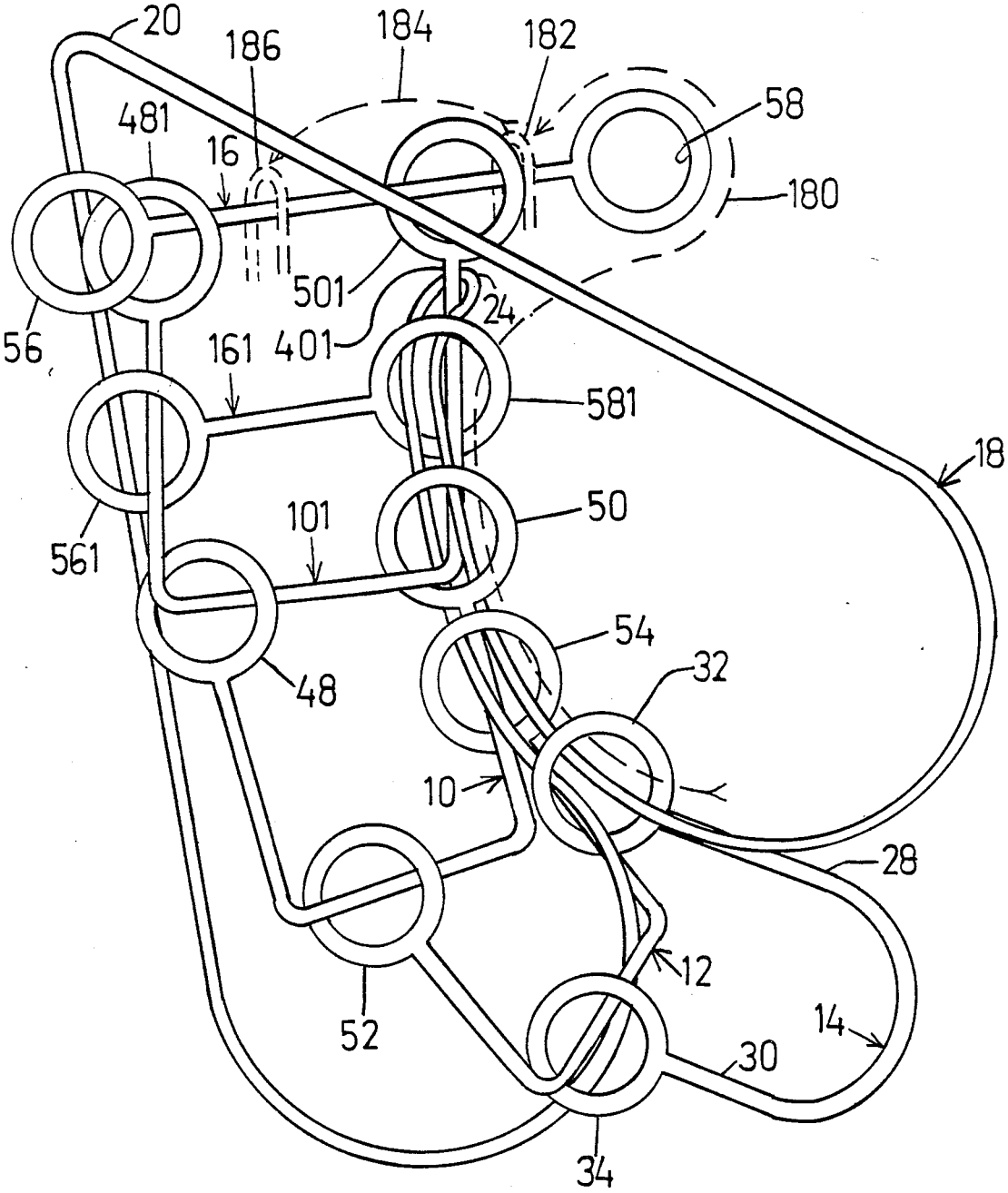
Figure 37:
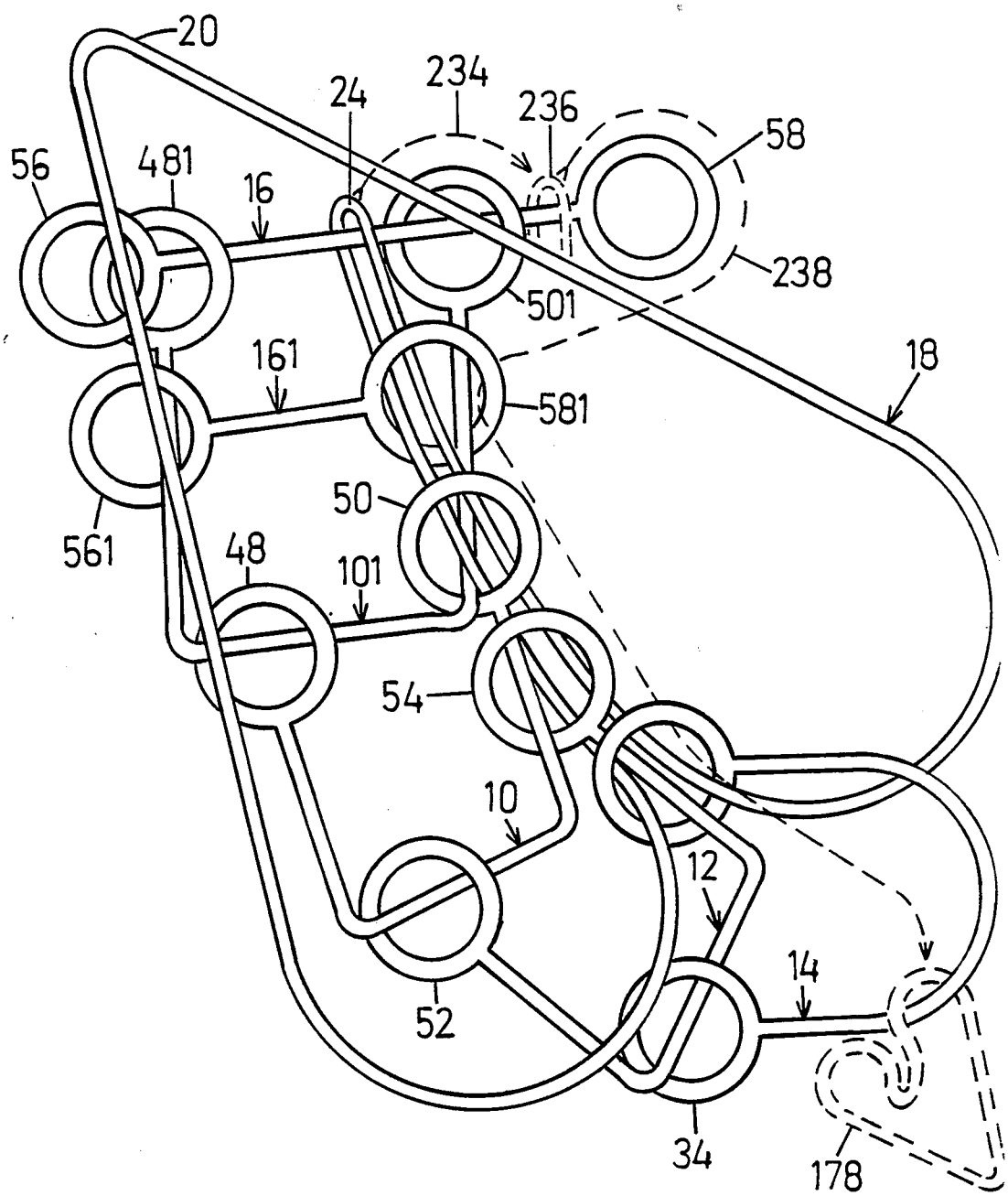

The last stage is to free heart element 18 from element 12 and place it on element 14, to position 178 shown in FIG. 37. From the position 162 in FIG. 29, tongue 24 is moved down and through loop 32 and follows arrow 180 in FIG. 30, through loops 54, and 581, behind loop 50 and around upstanding portion 401 on element 101, as shown in FIG. 30. It then continues to follow arrow 180 to straddle up and around loop 58 to dashed line position 182. From this position it straddles up and over loop 501, following arrow 184 to dashed line position 186 over crossbar 16. This position is also shown in FIG. 31.

Figure 31:
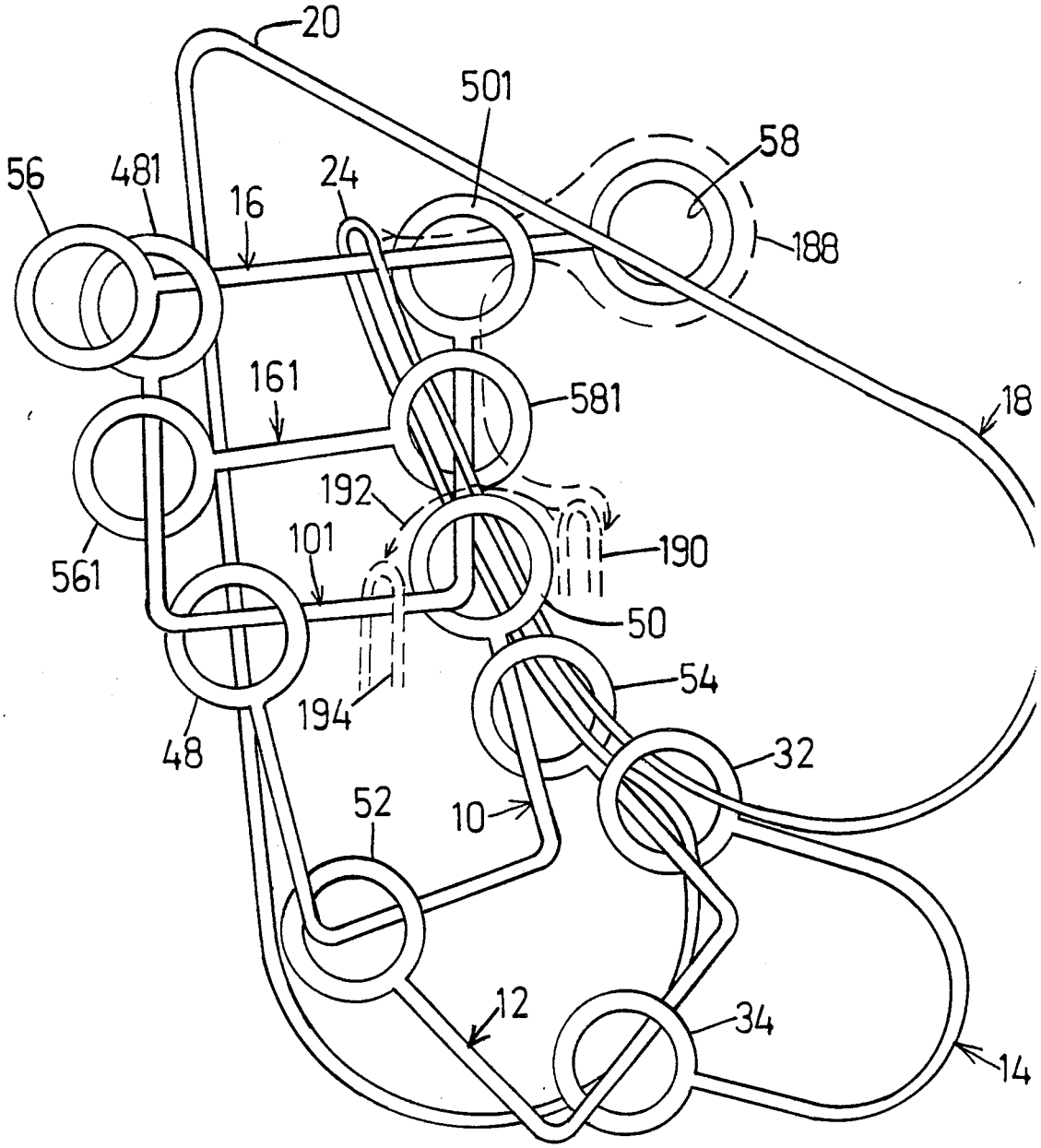

From the position of tongue 24 in FIG. 31, the tongue follows arrow 188 through loop 501, up and over loop 58, back through loop 501, back down through loop 581, following arrow 188 to its dashed line position 190. From this position tongue 24 straddles up and over loop 50, following arrow 192 to straddle U-shaped member 101 as shown by dashed line 194. This position of tongue 24 is also shown in FIG. 32.

Figure 32:
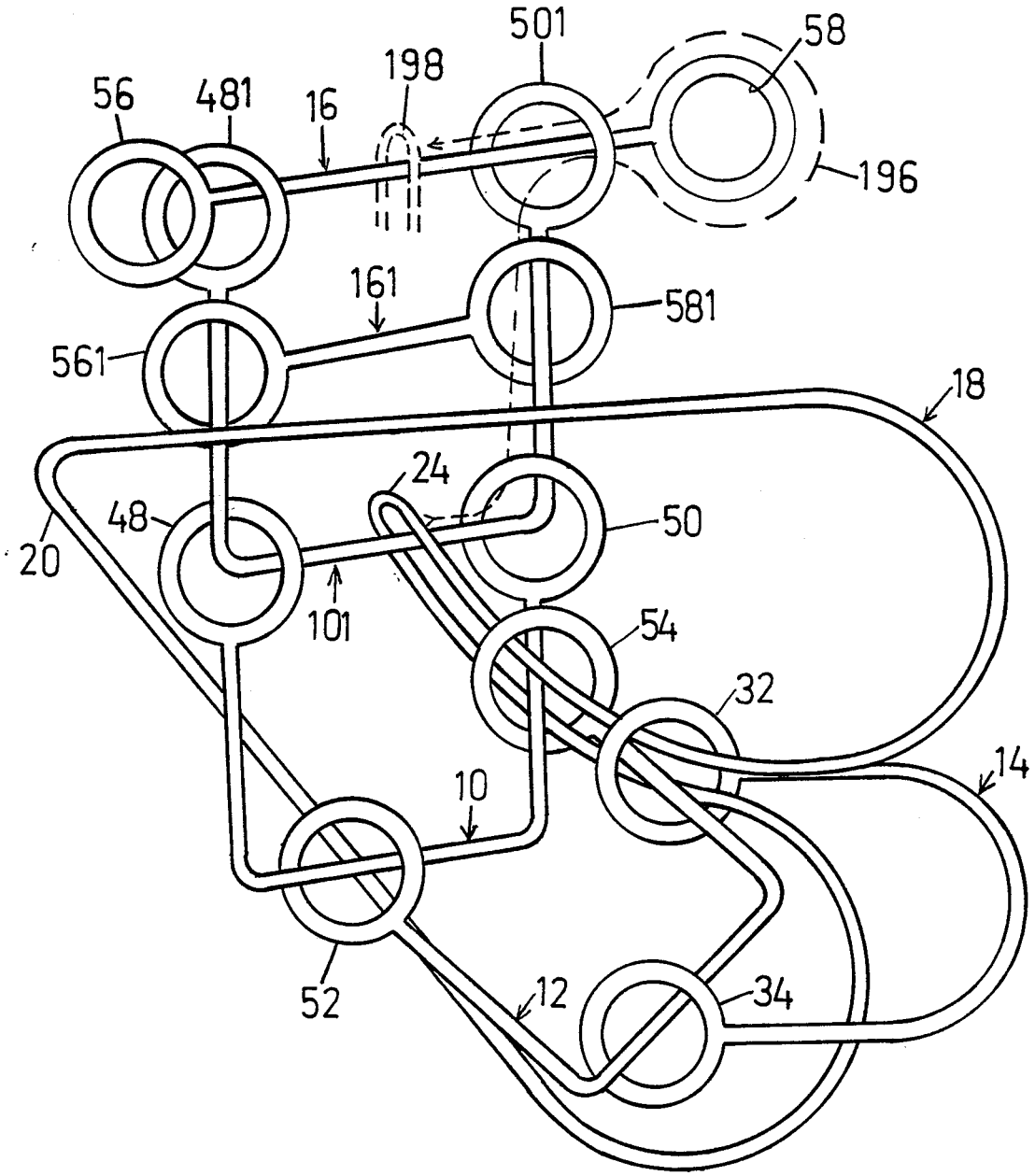

From its position in FIG. 32, tongue 24 rides the U-shaped member 101 up through loop 50, loop 581 and loop 501 as shown by arrow 196. It then straddles up and over loop 58 and back through loop 501 to its dashed line position 198 straddling crossbar 16. This position of tongue 24 is shown in FIG. 33.

Figure 33:
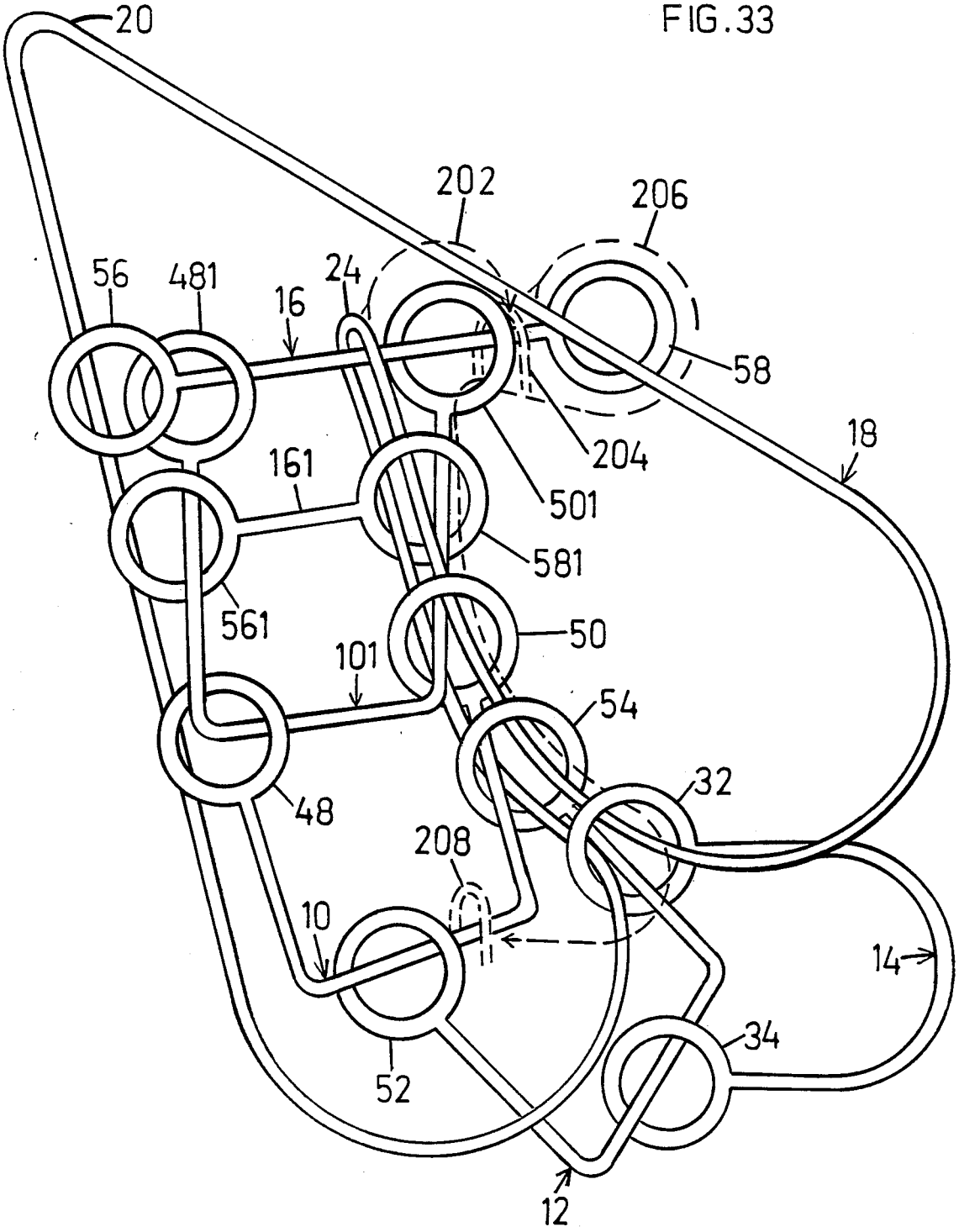

FIG. 33 shows movement of the tip of tongue 24 from straddling crossbar 16 to straddling of the U-shaped element 10 as shown by dashed line 208. This is done by the tongue 24 straddling up and over loop 501, following arrow 202 to its dashed line position 204 on crossbar 16. From here it is moved up, over and down on loop 58, following arrow 206. It then is moved back out of loops 501, 581, 50, 54 and 32. However, in so doing the tongue 24 continues to straddle U-shaped element 10, as shown by its dashed line position 208. This position of tongue 24 is shown in FIG. 34.

Figure 34:
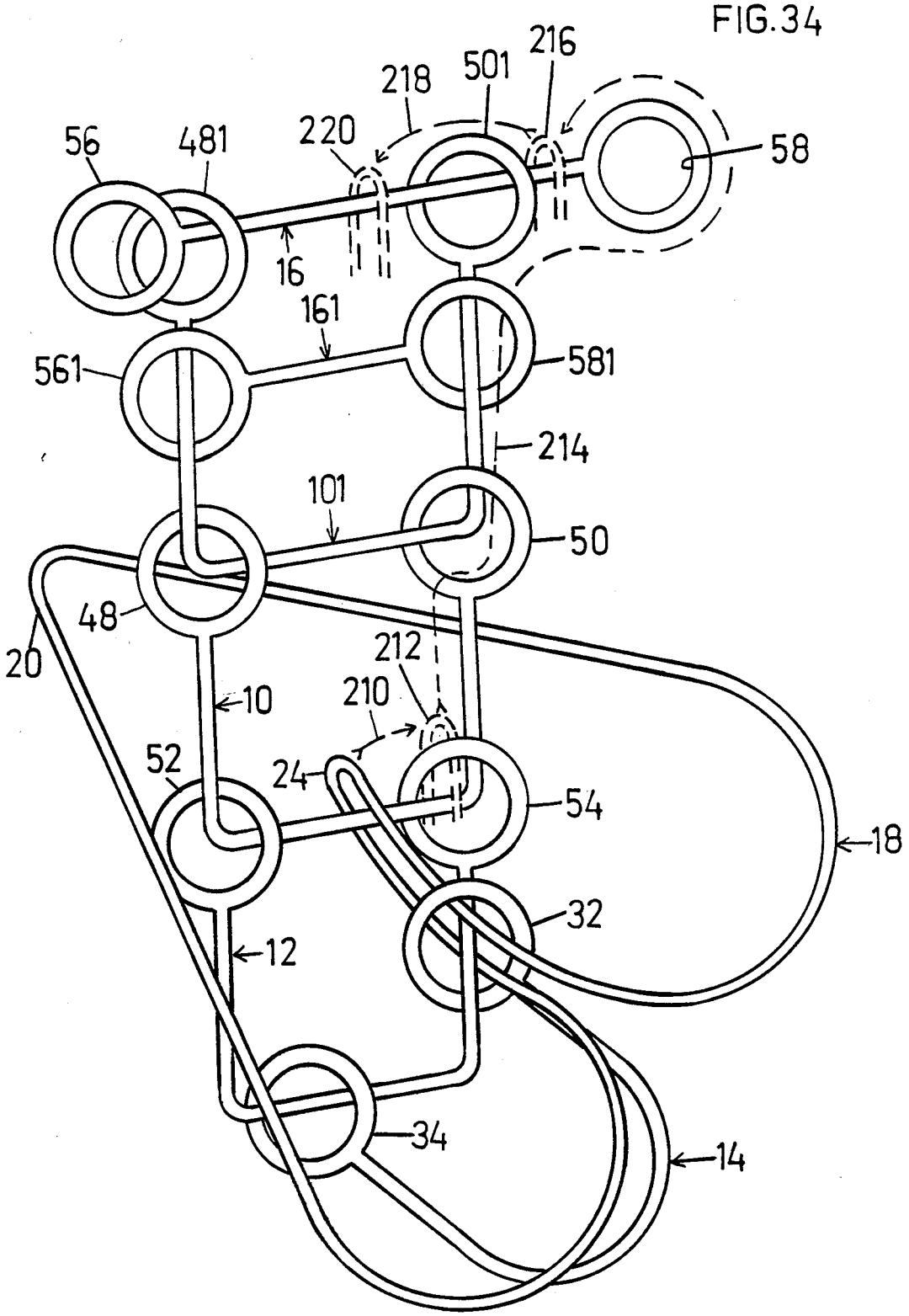

From its position in FIG. 34, tongue 24 straddles up and over loop 54, shown by arrow 210 to its position shown by dashed line 212. It then follows arrow 214 through loop 50, loop 581 and straddlles up and over loop 58 to its dashed line position 216 straddling crossbar 16. It then follows arrow 218 in an up and over straddle of loop 50 to its dashed line position 220 straddling crossbar 16. This position of tongue 24 is shown in FIG. 35.

Figure 35:
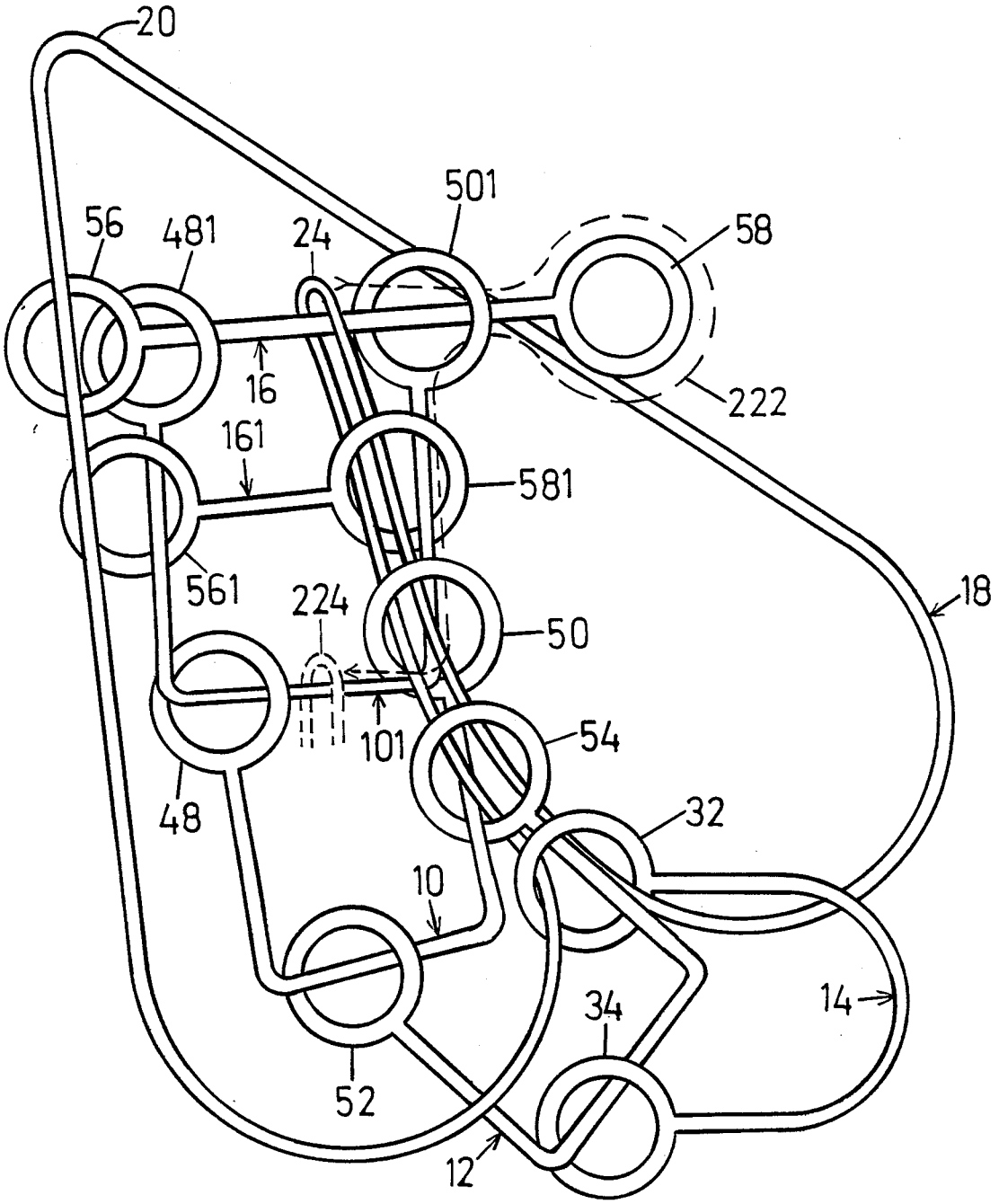
Figure 36:
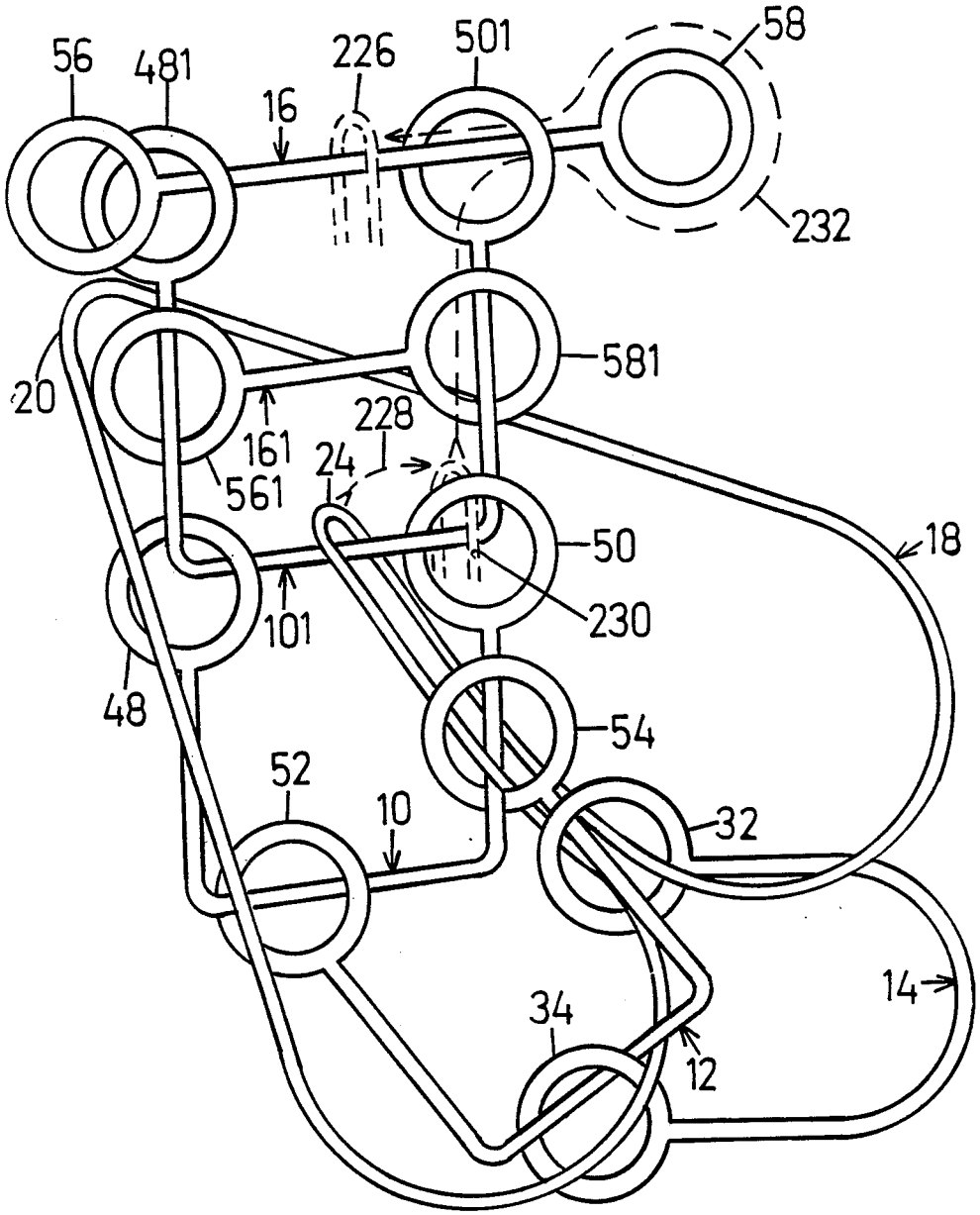

From its position in FIG. 35, tongue 24 follows arrow 222 through loop 50, up, over and down loop 58, back through loop 50, back through loops 581 and 50 to an interim straddled position on U-shaped element 101 as shown by dashed line 224. This position is also shown in FIG. 36. From this position tongue 24 must again straddle crossbar 16 as shown by dashed line 226. To do this, tongue 24 follows arrow 228 to straddle loop 50 to the position shown by dashed line 230 on U-shaped element 101. From there it follows arrow 232 through loop 581, through loop 50, up and over loop 58, back through loop 50 to the dashed line position 226. This position is shown in FIG. 37.

From its position on crossbar 16 in FIG. 37, tongue 24 follows arrow 234 up and over loop 50 to its straddle position 236 shown in dashed lines on crossbar 16. From there the tongue is passed up, over and around loop 58, back out from loop 581, and back out from loop 32, following arrow 238 to position the heart-shaped element 18 to its position 178 shown by dashed line straddling U-shaped element 14. When this is done, the puzzle is solved.

From the foregoing description of the preferred embodiments it will become obvious to one skilled in the art that improvements, alterations, modifications and additions may be made and it is to be understood that these changes are to be considered as included in my invention as set forth in the following claims.

What is claimed is:

1. A puzzle comprising:

a first crossbar having a loop at each end, a first U-shaped element having loops at the upper ends of its upstanding portions with the horizontal portion of said crossbar extending through these loops, a second U-shaped element having loops at the upper ends of its upstanding portions with the rung of said first U-shaped element extending through these loops, a third U-shaped element having loops at the upper ends of its upstanding portions with the rung of said second U-shaped element extending through these loops, a second crossbar having a loop at each end, said loops of said second crossbar respectively encircling the upstanding portions of said first U-shaped element, and a separate movable game piece of a heart shaped configuration that mey be engageable with said first crossbar and then sequentially engageable with said first, second, and third U-shaped elements, said game piece having a looped tongue insertable portion with spaced sides extending from a throat portion insertable into said loops and passable over said loops in accomplishing said sequential engagements, said game piece having enlarged rib portions thereof to prevent passage of said game piece through said loops, said game piece enlarged portions being in a flat plane and said insertable portion extending out of said plane.

2. A puzzle as set forth in claim 1 wherein said game piece is first affixed to said crossbar and then sequentially affixed to said first U-shaped element, to said second U-shaped element, and to said third U-shaped element.

3. A puzzle as set forth in claim 2 wherein said game piece is then sequentially affixed to said second U-shaped element, to said first U-shaped element, to said first crossbar and then freed from all parts of said puzzle.

4. A puzzle as set forth in claim 1 wherein a fourth U-shaped element having loops at the upstanding portions with the rung of said third U-shaped element extending through these loops.

5. A puzzle as set forth in claim 4 wherein said game piece is first affixed to said first crossbar, and then sequentially affixed to said first U-shaped element with said second crossbar thereon, then to said second U-shaped element, then to said third U-shaped element, and then to said fourth U-shaped element.

6. A puzzle as set forth in claim 5 wherein said game piece is then sequentially affixed to said third U-shaped element, to said second U-shaped element, to said first crossbar and then freed from all parts of said puzzle.

* * * * *